US012595714B2

(12) United States Patent
Stepchinsky et al.

(10) Patent No.: US 12,595,714 B2
(45) Date of Patent: Apr. 7, 2026

(54) SYSTEMS AND METHODS FOR RIGIDIZING A SEAL

(71) Applicant: Innovex International, Inc., Houston, TX (US)

(72) Inventors: John Stepchinsky, Spring, TX (US); David A. Scantlebury, Richmond, TX (US); Todd L. Scaggs, Fulshear, TX (US); Gregory K. Norwood, Boerne, TX (US); John Trahan, Houston, TX (US); Adam Forness, Cypress, TX (US); Andrew B. Mitchell, Houston, TX (US)

(73) Assignee: Innovex International, Inc., Houston, TX (US)

( * ) Notice: Subject to any disclaimer, the term of this patent is extended or adjusted under 35 U.S.C. 154(b) by 0 days.

(21) Appl. No.: 18/658,757

(22) Filed: May 8, 2024

(65) Prior Publication Data

US 2025/0347187 A1 Nov. 13, 2025

(51) Int. Cl.
*E21B 33/04* (2006.01)

(52) U.S. Cl.
CPC ..... *E21B 33/04* (2013.01); *E21B 2200/01* (2020.05)

(58) Field of Classification Search
CPC ..... E21B 33/04; E21B 33/0422
See application file for complete search history.

(56) References Cited

U.S. PATENT DOCUMENTS

| | | | | |
|---|---|---|---|---|
| 4,691,780 | A | 9/1987 | Galle, Jr. et al. | |
| 2017/0167218 | A1* | 6/2017 | Cheah | E21B 23/02 |
| 2017/0254166 | A1* | 9/2017 | Berryhill | E21B 33/035 |
| 2022/0127913 | A1* | 4/2022 | Armistead | E21B 41/0035 |
| 2023/0026935 | A1* | 1/2023 | Mitchell | E21B 33/0415 |

OTHER PUBLICATIONS

Patents Act 1977: Search Report under Section 17(5) from the Intellectual Property Office, GB Application No. GB2506360.3 mailed Aug. 13, 2025, 5 pages.

* cited by examiner

*Primary Examiner* — David Carroll
(74) *Attorney, Agent, or Firm* — Baker Botts L.L.P.

(57) ABSTRACT

A system includes a seal assembly configured to retain a casing hanger within a wellhead. The seal assembly includes: a main body including at least one tapered surface on an upper end thereof; a lock ring coupled to the main body and configured to expand radially outward into a profile on an inner diameter of the wellhead; and a cam ring disposed above the main body and having at least one tapered surface on a lower end thereof, the at least one tapered surface of the cam ring interfacing with the at least one tapered surface of the main body such that rotation of the cam ring in a first direction with respect to the main body causes the lock ring to move axially upward.

20 Claims, 21 Drawing Sheets

SYSTEMS AND METHODS FOR RIGIDIZING A SEAL

TECHNICAL FIELD

The present disclosure relates generally to assemblies used to secure a casing hanger within a wellhead and, more particularly, to an assembly used to rigidize a seal between the casing hanger and the wellhead.

BACKGROUND

Conventional wellhead systems include a wellhead housing and a subsurface casing string extending from the wellhead into a well bore. During a drilling procedure, a drilling riser and a blowout preventer (BOP) are installed above a wellhead housing to provide pressure control as casing is installed, with each casing string having a casing hanger on its upper end for landing on a shoulder within the wellhead housing.

For various reasons, a casing hanger within the wellhead may move axially upward, particularly when the wellhead is part of a production system where downhole fluids at elevated temperatures thermally expand the casing string and thus exert a substantial upward force on the casing hanger. Since the casing hanger seal is intended for sealing at a particular location on the wellhead, upward movement of the casing hanger and the seal assembly is detrimental to reliably sealing the casing annulus. A lockdown component can be used to prevent axial movement of the casing hanger in response to such axial forces.

Various types of lockdown components have been conceived for axially interconnecting a casing hanger and a subsea wellhead. The lockdown component (e.g., a lockdown sleeve) may be incorporated into the seal assembly. Such a seal assembly, once run in and locked into the wellhead, prevents axial (i.e., vertical) movement of the uppermost casing hanger and the seal with respect to the wellhead. Typically, a seal assembly is run into the wellhead on an associated running tool, landed on the casing hanger, and locked to a locking profile on an inner wall of the wellhead housing to axially secure the casing hanger within the wellhead. To install conventional seal assemblies, it is first necessary to run a lead impression tool into the wellhead to measure the distance between the top of the casing hanger and the housing locking profile. After retrieving the lead impression tool to the surface, the measured dimension can be obtained. With this information, the seal assembly length can be adjusted at the surface so that once the seal assembly is run in and secured to the wellhead, it provides a zero-gap connection between the casing hanger and the wellhead housing and any desired pre-load.

This process of taking measurements in the wellhead via a lead impression tool, retrieving the tool to the surface, and then adjusting and installing a seal assembly into the wellhead is a time-consuming installation process requiring multiple trips into the wellhead. It is now recognized that a need exists for a seal assembly that can be adjusted once it is already landed in the wellhead.

SUMMARY

In accordance with the above, presently disclosed embodiments are directed to a method and system for using a seal assembly system to rigidize a seal.

Among the many potential advantages to the methods, apparatus, and systems of the present disclosure, only some of which are alluded to herein, the present disclosure may provide a seal assembly for rigidizing a seal between a casing hanger and wellhead. The seal assembly may function without shear pins, keys, or other breakable devices. For example, the seal assembly may use weight set pressure assist to achieve a positive confirmation that the seal is rigidized. As another example, the seal assembly may use a plurality of levels of a resettable actuator and a torque ring assembly which is attached to the actuator for rigidizing the seal.

In an embodiment, the seal assembly may be configured to retain a casing hanger within a wellhead. The seal assembly may include a main body, a lock ring, and a cam ring. The main body includes at least one tapered surface on an upper end thereof. The lock ring may be coupled to the main body and configured to expand radially outward into a profile on an inner diameter of the wellhead. The cam ring may be disposed above the main body and having at least one tapered surface on a lower end thereof, the at least one tapered surface of the cam ring interfacing with the at least one tapered surface of the main body such that rotation of the cam ring in a first direction with respect to the main body causes the lock ring to move axially upward.

In an embodiment, the seal assembly may include at least one ramp coupled to a radially inner surface of the cam ring and a rotator ring having at least one ramp portion configured to interface with the at least one ramp upon lowering of the rotator ring with respect to the main body such that further lowering of the rotator ring causes the at least one ramp and the cam ring to rotate in the first direction. The seal assembly may include an actuator, wherein an interface between the actuator and the lock ring may be capable of transferring an axial force from the actuator into outward radial expansion of the lock ring. The actuator may be releasably coupled to the rotator ring. The seal assembly may include a pressure-actuated release mechanism coupling the actuator to the rotator ring using a first set of levers and a second set of levers. The first set of levers act as radial cantilever beams with a first load concentrated at the end of the radial cantilever beams and the second set of levers act as axial cantilever beams with a second load concentrated at the end of axial cantilever beams. The pressure-actuated release mechanism may include a lever coupled to and extending from the rotator ring and a groove formed in the actuator, wherein a distal end of the lever may be disposed in the groove formed in the actuator. At least one tapered surface of the main body and the at least one tapered surface of the cam ring are angled approximately 0 to 90 degrees from horizontal.

In an embodiment, the seal assembly may include a radially expandable spaceout indicator ring extending through a corresponding one or more slots in the cam ring, wherein the radially expandable spaceout indicator ring may be configured to expand into a corresponding profile on the inner diameter of the wellhead to allow a lockdown sleeve of the seal assembly to travel its full stroke for rigidly locking the seal assembly in the wellhead. The seal assembly further comprises a seal coupled to the main body. The seal may be configured to seal an annulus between the casing hanger and the wellhead.

In an embodiment, the seal assembly may include a torque ring. The torque ring may include a ring body, a first tab, and a second tab. The first tab and the second tab are operable to transfer a torque to a tab on a threaded adjustment ring. The first tab is longer than the second tab in length. In particular, the first tab extends through a split in a lockdown sleeve to interface with the threaded adjustment ring. The second tab interfaces with a mating slot in the lock ring opposite from the split in the lockdown sleeve.

In an embodiment, the present disclosure may provide a method for positioning a seal assembly into a wellhead. The seal assembly includes a main body, a lock ring, and a cam ring. The main body may have at least one tapered surface on an end thereof. The lock ring may be coupled to the main body. The cam ring may be coupled to the main body and having at least one tapered surface on an end thereof, the at least one tapered surface of the main body interfacing with the at least one tapered surface of the cam ring. The method may actuate the lock ring of the seal assembly toward a profile on an inner diameter of the wellhead. During or after actuating the lock ring, the method may adjust an axial length of the seal assembly by rotating the cam ring in a first direction with respect to the main body. The rotational movement of the cam ring may cause the lock ring to move axially upward. The method may retain a casing hanger in the wellhead via the seal assembly.

In an embodiment, the method may lower a rotator ring of the seal assembly with respect to the main body. The rotator ring may have at least one ramp portion thereon. The method may interface the at least one ramp portion of the rotator ring with at least one ramp that may be coupled to the cam ring. The method may lower the rotator ring further with respect to the main body to cause the at least one ramp and the cam ring to rotate in the first direction with respect to the main body via interaction of the at least one ramp portion of the rotator ring with the at least one ramp. The method may actuate the lock ring via an actuator being lowered with respect to the main body. The actuator may be releasably coupled to the rotator ring. The method may release the rotator ring from the actuator upon further lowering the actuator with respect to the main body. The method may land the actuator on a landing shoulder of the main body after releasing the rotator ring from the actuator. The method may release the rotator ring from the actuator by forcing a lever coupled to the rotator ring to flex such that a distal end of the lever extending from the rotator ring moves out of a groove formed in the actuator. The method may expand a radially expandable spaceout indicator ring into a corresponding profile on the inner diameter of the wellhead, the radially expandable spaceout indicator ring extending through a corresponding one or more slots in the cam ring to allow a lockdown sleeve of the seal assembly to travel its full stroke for rigidly locking the seal assembly in the wellhead. The method may seal an annulus between the casing hanger and the wellhead via a seal coupled to the main body of the seal assembly. The method may deter movement of the seal in an axial direction via a connection between the casing hanger, the seal assembly, and the wellhead. A gap may be present between an uppermost edge of the lock ring and an uppermost edge of the profile of the wellhead when the lock ring is initially actuated. There is no gap between the uppermost edge of the lock ring and the uppermost edge of the profile of the wellhead after adjustment of the axial length of the seal assembly.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
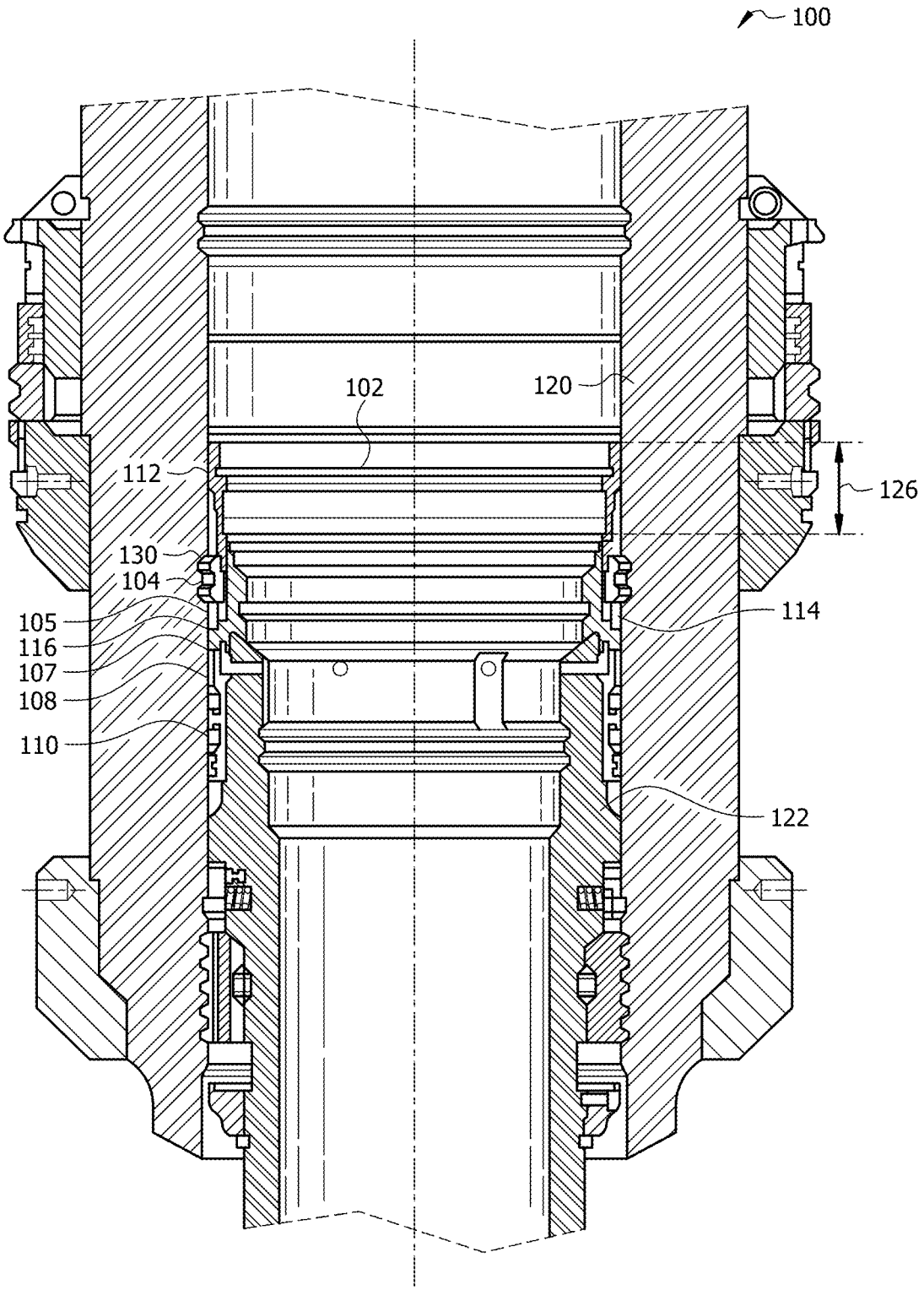
FIG. 1 illustrates a front view of a seal assembly as run, according to one or more embodiments of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system-related and business-related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments of the present disclosure may be directed to systems and methods for rigidizing a seal using a seal assembly.

A seal assembly may be used to position a seal between a casing hanger and a wellhead housing and to axially interconnect the casing hanger to the wellhead. The seal assembly may be locked into the wellhead, thereby preventing axial movement of the casing hanger, and the seal, with respect to the wellhead.

In some cases, machining tolerances may give rise to small gaps between a locking mechanism (e.g., lock ring) of the seal assembly and an upper edge of a complementary lock profile of the wellhead when the seal assembly is landed and locked to seal the annulus between the casing hanger and the wellhead. Such gaps may allow the seal located between the casing hanger and the wellhead to move up and down axially in response to pressure differentials. Over time, this motion of the seal can cause undesirable wear on the seal.

The disclosed seal assembly overcomes these deficiencies by using a cam operated hold-down mechanism to reduce any gaps, thereby rigidizing the system. The seal assembly may be configured to retain a casing hanger within a wellhead. The seal assembly generally includes a main body which is substantially cylindrical, a lock ring coupled to the main body, and a cam ring disposed above the main body. The lock ring may be configured to expand radially outward into a profile on an inner diameter of the wellhead. The main body has at least one tapered surface on an upper end thereof, and the cam ring has at least one tapered surface on a lower end thereof. The at least one tapered surface of the cam ring interfaces with the at least one tapered surface of the main body such that rotation of the cam ring in a first direction with respect to the main body causes the lock ring to move axially upward. This axially upward movement transferred to the lock ring helps to close any axial gap between the lock ring and the wellhead profile (and applying any desired pre-load), thus rigidizing the seal. The installation process for the seal assembly may be accomplished during one trip into the wellhead, as opposed to a first trip with a lead impression tool followed by an adjustment of a lockdown component of the seal assembly at the surface and a subsequent trip downhole to install the adjusted seal assembly. The disclosed systems and method provide both time savings (since only one trip into the wellhead is necessary) and cost savings (since an additional lead impression tool is not required) compared to existing seal assembly installation techniques. In addition, the seal assembly having a wedge shaped component is easy to construct and operate compared to other, more complicated lockdown assemblies that utilize rotating components, etc.

In an embodiment, the seal assembly may include a resettable actuator to apply one or more pressure-actuated release mechanisms to move and rotate an actuator ring to push down the seal assembly. Alternative to shear pins, the resettable actuator may be reused so that the seal assembly may be re-used if it has to be brought back up to the surface to reset the seal. In an embodiment, operation of the seal assembly may begin by running the assembly into the wellhead in a collapsed state. Once the seal assembly lands on the casing hanger, an axial force (set down weight from a running tool) may be applied to the resettable actuator of the seal assembly. The axial force may cause one or more of the actuator ring and a rotator ring of the seal assembly to descend, thereby pushing a lock ring into one or more grooves in the wellhead housing. The actuator ring may be releasably coupled to the rotator ring. The resettable actuator may also include a small split ring located in a gap of a cam ring. The split ring may snap into place once the lock ring is engaged with the uppermost part of the grooves in the wellhead housing. Thus, the resettable actuator may not move down until a split ring snaps out into one of the plurality of lockdown grooves. When the resettable actuator snaps into place, it indicates that the system is rigidized. Therefore, an interface between the actuator ring and the lock ring may be capable of transferring the axial force from the actuator ring into outward radial expansion of the lock ring. As additional axial force is applied (for example, as additional weight is allowed to push on the seal assembly), the actuator ring and/or rotator ring may continue to descend, thereby causing a cam ring to rotate upon one or more ramps. The cam ring may ascend up the one or more ramps as it rotates, thereby pushing the lock ring up and closing the gap between the wellhead housing and the seal assembly. Once sufficient axial force has been exerted upon the actuator ring, one or more pressure-actuated release mechanisms may be actuated, thereby allowing the actuator ring to snap into place. The actuator ring may then provide a new shoulder for another wellhead component to be loaded upon.

In an embodiment, the seal assembly may include a spaceout indicator ring which expands radially through a space in the cam ring to keep the lock ring from fully setting the seal until it is in position to do so. The seal assembly may use the spaceout indicator ring to implement a smart release mechanism to engage a wellhead indicator groove by expanding to a fail position. The spaceout indicator ring may not snap into the wellhead housing until the lock ring reaches an appropriate place. When the lock ring is in proper position, the spaceout indicator ring may snap out and release the lockdown sleeve, thereby allowing the lockdown sleeve to progress downward. Thus, the spaceout indicator ring may be used to verify that lock ring is rigidly locked in wellhead housing and the lock ring engages the casing hanger. When the lock ring is not rigidly locked in wellhead housing, a lockdown sleeve may not travel sufficiently to implement the smart release mechanism of the running tool.

In an embodiment, the seal assembly may include a torque ring comprising a ring body, a first tab, and a second tab. This first tab and the second tab are operable to transfer a torque to a tab on a threaded adjustment ring. In particular, the first tab is longer than the second tab in length. The first tab may extend through a split in a lockdown sleeve to interface with the threaded adjustment ring. The second tab may interface with a mating slot in the lock ring opposite from the split in the lockdown sleeve. The torque ring may be configured to be rotated and torqued to close a gap between the lockdown ring and the upper edge of the complementary profile on the inner surface of wellhead housing.

Figure 2:
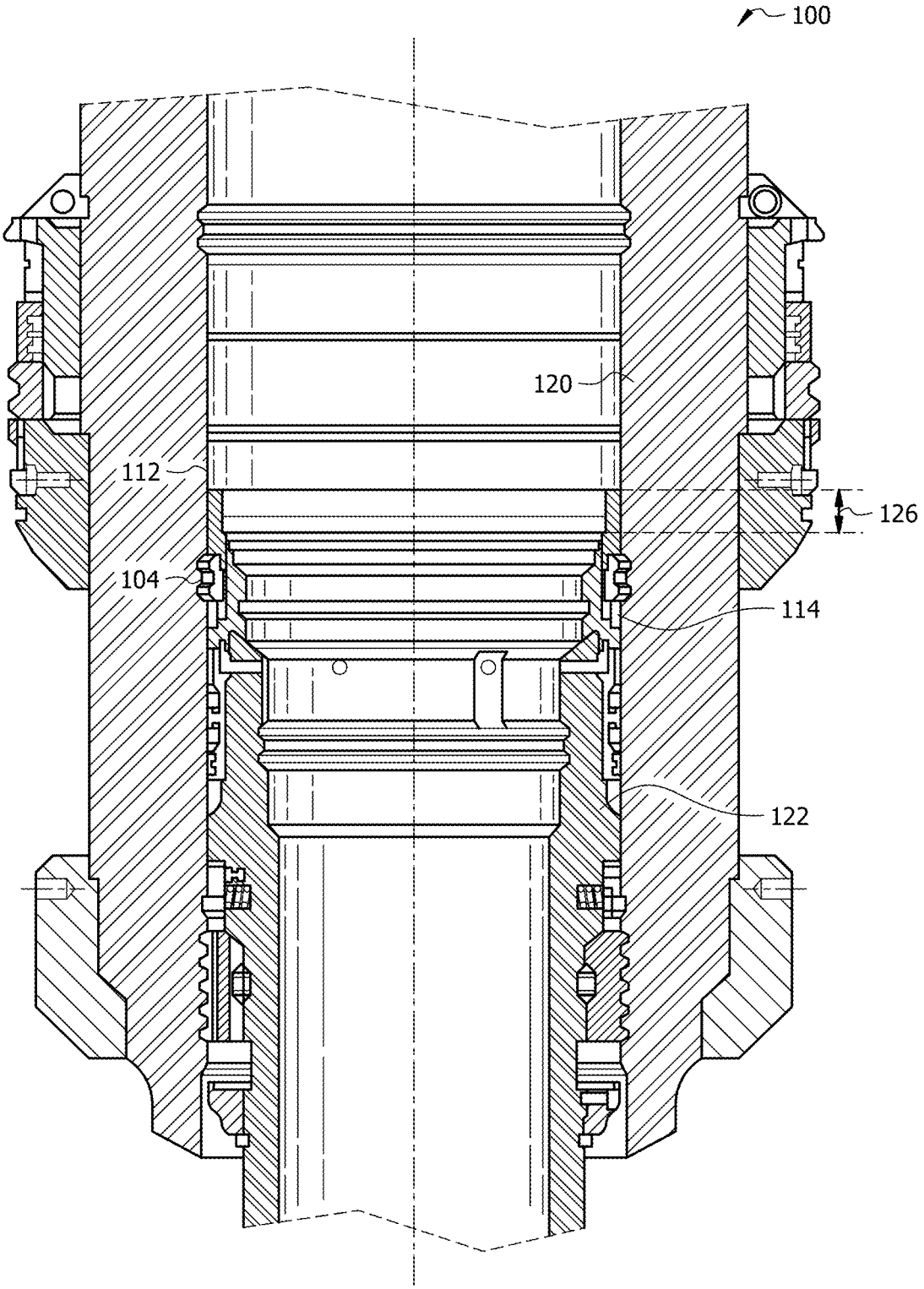
FIG. 2 illustrates a front view of a seal assembly at maximum rotation and rigidized, according to one or more embodiments of the present disclosure.
Figure 3:
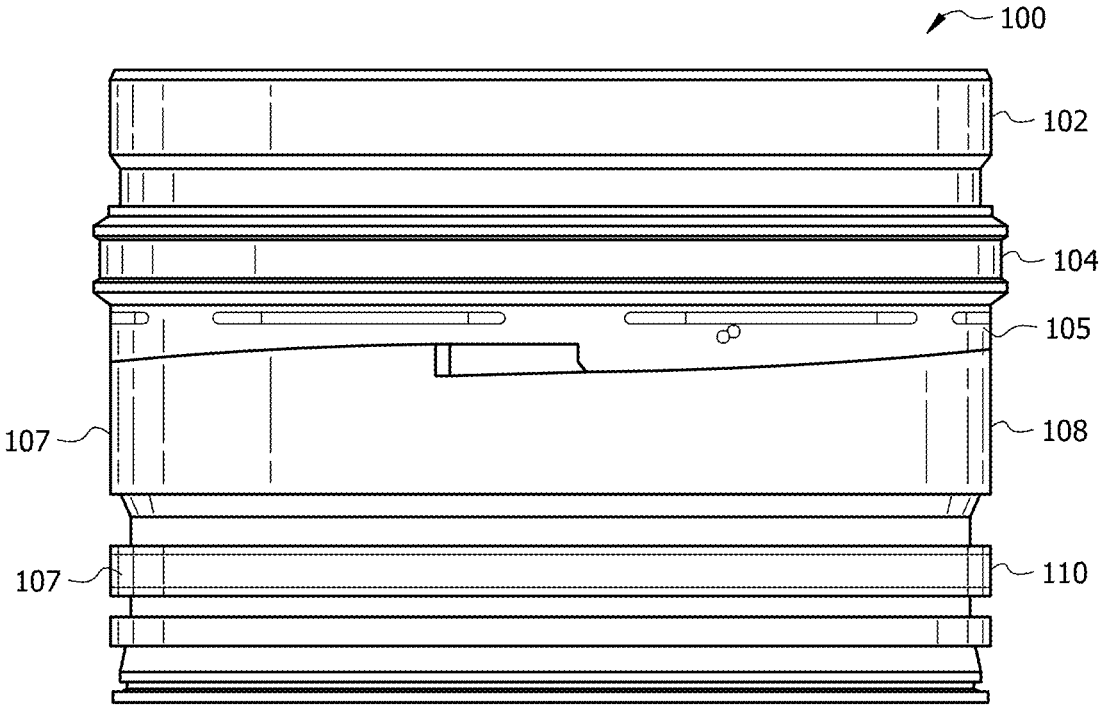
FIGS. 3 and 4 illustrate partial cutaway view of a seal assembly, according to one or more embodiments of the present disclosure.
Figure 4:
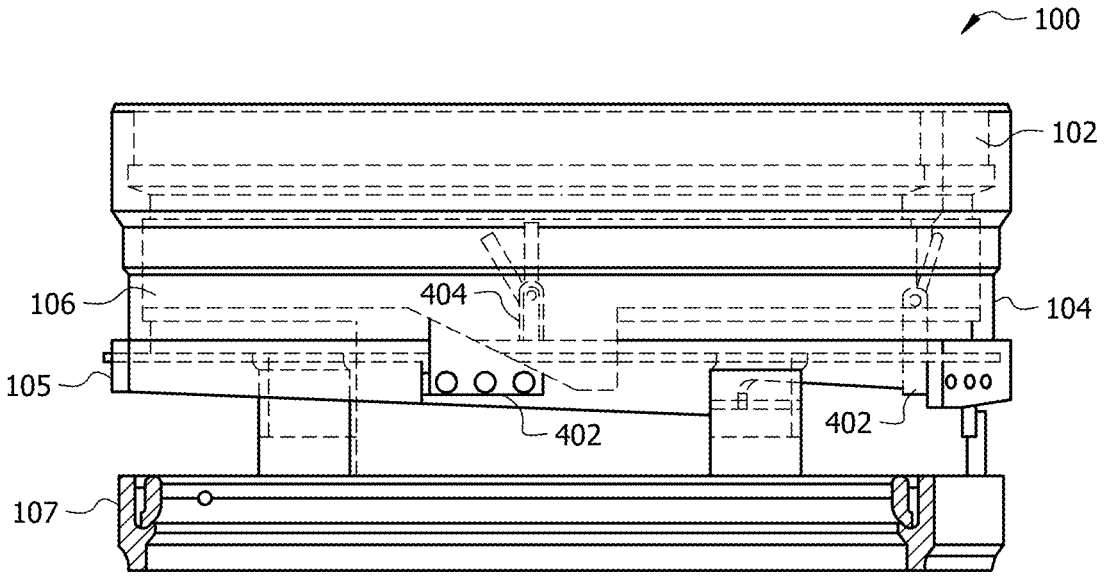

FIGS. 1-4 illustrate views of a seal assembly 100, according to one or more embodiments. Specifically, FIG. 1 illustrates a partial cutaway view of an unengaged seal assembly 100 having a rigidized wellhead indicator. FIG. 2 illustrates a partial cutaway view of an engaged seal assembly 100 having a rigidized wellhead indicator. FIG. 3 illustrates a partial cutaway view of the seal assembly 100 of FIG. 2 interfacing with an internal surface of a wellhead. FIG. 4 is rotated 90 degrees with respect to FIG. 3.

FIG. 1 illustrates a front view of a seal assembly 100 as run, according to one or more embodiments of the present disclosure. The seal assembly 100 may be configured to retain a casing hanger within a wellhead. The seal assembly 100 may include a main body comprising at least one tapered surface on an upper end thereof, a lock ring 104 coupled to the main body and configured to expand radially outward into a profile on an inner diameter of a wellhead housing 120, and a cam ring 105 disposed above the main body and having at least one tapered surface on a lower end thereof. The main body is substantially cylindrical. The at least one tapered surface of the cam ring 105 may interface with the at least one tapered surface of the main body such that rotation of the cam ring 105 in a first direction with respect to the main body causes the lock ring 104 to move axially upward. A casing hanger 122 may be landed and secured to the wellhead housing 120. Thus, casing hanger 122 may provide support for the casing string when it is lowered into a wellbore. Seal assembly 100 may be subsequently landed, wherein a seal 107 may be set. Seal 107 may be coupled to the main body of seal assembly 100. Seal 107 may be configured to seal an annulus between casing hanger 122 and the wellhead housing 120. Thus, movement of the seal 107 may be deterred in an axial direction via a connection between the casing hanger 122, the seal assembly 100, and the wellhead housing 120.

Seal assembly 100 may include a standoff 126 to separate a lockdown sleeve 112 and a lock ring 104 for the seal assembly 100 to rigidize the seal assembly 100. In embodiments, the standoff 126 may be 4.27 inches for seal assembly 100 as run. Seal assembly 100 may include a spaceout indicator ring 114 which may expand radially through a space, such as one or more slots, in a cam ring 105 to keep the lock ring 104 from fully setting the seal until it is in position to do so. In particular, seal assembly 100 may be equipped with an actuator ring 102, the lockdown sleeve 112, the lock ring 104, the cam ring 105, and the seal 107 having an upper body 108 and a lower body 110. In particular, actuator ring 102 may be coupled to an end of the seal assembly 100 to push out the lock ring 104. Lockdown sleeve 112 may be positioned in the wellhead housing 120 by a running tool for limiting axial movement of the casing hanger 122 by axially securing the casing hanger 122 to the wellhead housing 120. Lock ring 104 may be disposed radially about a neck of the casing hanger 122 and include ridges along its outer circumference to extend into a recess in a wall of wellhead housing 120. Cam ring 105 may be coupled to a plurality of ramps and include a small split ring, such as a snap ring, located in a gap of the cam ring. The split ring may snap out into a corresponding groove formed in the wellhead housing 120 below a plurality of lock ring grooves. The split ring may snap into place once lock ring 104 is engaged with the uppermost part of the lock ring grooves in the wellhead housing 120.

Figure 9:
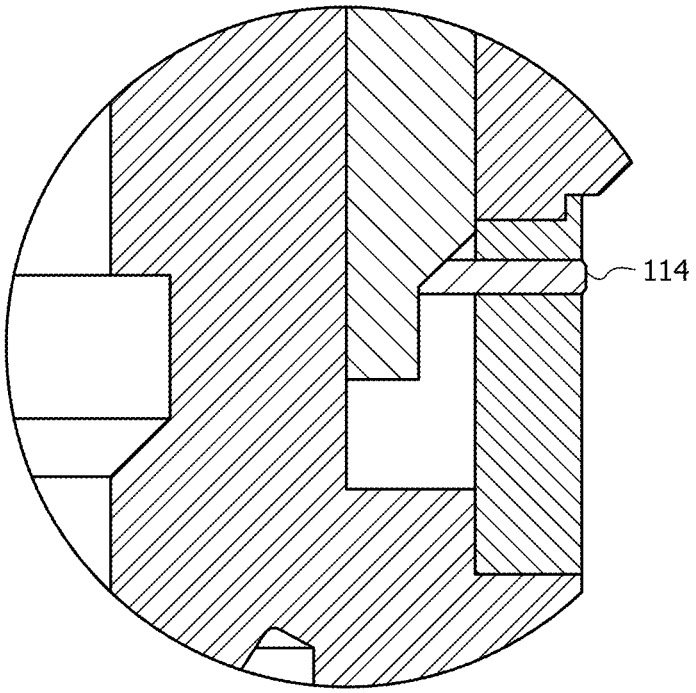
FIG. 9 illustrates a cross-sectional view of the seal assembly of FIG. 1 with the spaceout indicator ring in a first position indicating the seal is not rigidized, in accordance with an embodiment of the present disclosure.

In certain embodiments, the seal assembly 100 may be landed on the casing hanger 122 via a running tool. An axial force may be applied to seal assembly 100; for example, in certain embodiments, the weight of seal assembly 100 and the running tool may exert an axial force. A gap 130 may exist between top of lock ring 104 and uppermost edge of lock ring grooves near the upper edge of the complementary profile on the inner surface of wellhead housing 120. In particular, the gap 130 may be present between an uppermost edge of the lock ring 104 and an uppermost edge of the profile of the wellhead when the lock ring 104 is initially actuated. There is no gap between the uppermost edge of the lock ring 104 and the uppermost edge of the profile of the wellhead housing 120 after adjustment of the axial length of the seal assembly 100. As the axial force is applied, a resettable actuator may apply one or more pressure-actuated release mechanisms to move and rotate actuator ring 102 to push down the seal assembly 100 (as depicted in FIGS. 3 and 9, and as described in more detail below).

In an embodiment, the one or more pressure-actuated release mechanisms may comprise one or more shear pins. In certain embodiments, a resettable actuator may apply the one or more pressure-actuated release mechanisms to allow actuator ring 102 to move down and push out lock ring 104 into a plurality of lock ring grooves to close gap 130. Actuator ring 102 may thereby rotate lock ring 104 and cam ring 105. As cam ring 105 rotates, it may be lifted by one or more ramps, as depicted in FIG. 4 and described in more detail below. Rotation of cam ring 105 may create a radial gap 116 between the upper body 108 and the cam ring 105. As radial gap 116 increases in size, lock ring 104 and actuator ring 102 may be pushed upwards by cam ring 105 to accommodate for the space occupied by radial gap 116. The inversely corresponding gap 130 between lock ring 104 and the upper edge of the complementary profile on the inner surface of wellhead housing 120 may thereby shrink, ultimately rigidizing the system. The resettable actuator may not move down until the split ring snaps out into one of the plurality of lockdown grooves. When the resettable actuator snaps into place, it indicates that the system is rigidized. Once the system is rigidized, the seal assembly 100 may be locked into place for removal of the running tool. Systems without means for rigidizing seal 107 between casing hanger 122 and wellhead housing 120 may be exposed to an increased risk of fatigue-induced failure due to repeated axial movement.

FIG. 2 illustrates a front view of a seal assembly 100 at maximum rotation and rigidized, according to one or more embodiments of the present disclosure. In embodiments, standoff 126 may be 1.72 inches for the seal assembly 100 after the seal is rigidized. It is possible to use a cam operated axially constraining hold down mechanism to release or rigidize the seal assembly 100 and lockdown sleeve 112 in a single trip by utilizing the running tool with weight set pressure assist. A spaceout indicator ring 114 may include a rigidized wellhead indicator to implement a smart release mechanism to engage a wellhead indicator groove by expanding to a fail position. The spaceout indicator ring 114 may be configured to expand into a corresponding profile on the inner diameter of the wellhead housing 120 to allow a lockdown sleeve 112 of the seal assembly 100 to travel its full stroke for rigidly locking the seal assembly 100 in the wellhead housing 120. Thus, the rigidized wellhead indicator may be used to verify that lock ring 104 is rigidly locked in wellhead housing 120 and lock ring 104 engages casing hanger 122. If lock ring 104 is not rigidly locked in wellhead housing 120, lockdown sleeve 112 may not travel sufficiently to implement the smart release mechanism of the running tool.

FIGS. 3 and 4 illustrate partial cutaway view of a seal assembly 100, according to one or more embodiments of the present disclosure. An exterior view of actuator ring 102, lock ring 104, cam ring 105, rotator ring 106, and seal 107 (including an upper body 108 and a lower body 110) of FIGS. 1 and 2 are depicted in FIG. 3. In the seal assembly 100, actuator ring 102 may be disposed above rotator ring 106, which may be disposed within the interior of the seal assembly 100. Lock ring 104 may be disposed above cam ring 105, which may be disposed above seal 107. The upper body 108 is an upper seal body which may include one or more ramps 402 (referring to FIG. 4) to interact with complementary ramps of the cam ring 105. The lower body 110 is a lower seal body between the wellhead housing 120 and the casing hanger 122.

In certain embodiments, FIG. 4 shows a resettable actuator of the seal assembly 100. The interface between the resettable actuator and the lock ring 104 is capable of transferring an axial force from the resettable actuator into outward radial expansion of the lock ring 104. In particular, the resettable actuator may apply a rigidizing mechanism for the seal assembly 100 to function without shear pins, keys, or other breakable device. For example, the seal assembly 100 may comprise at least one ramp, such as ramps 402, coupled to a radially inner surface of the cam ring 105. A rotator ring 106 may have at least one ramp portion configured to interface with the at least one ramp upon lowering of the rotator ring 106 with respect to the main body of the seal assembly 100 such that further lowering of the rotator ring 106 causes the at least one ramp and the cam ring 105 to rotate in the first direction. The resettable actuator may be releasably coupled to the rotator ring 106. For example, the resettable actuator may release the rotator ring 106 from the resettable actuator upon further lowering the actuator with respect to the main body of the seal assembly 100.

As another example, the resettable actuator may be landed on a landing shoulder of the main body of the seal assembly 100 after releasing the rotator ring 106 from the resettable actuator.

In certain embodiments, as an axial force is applied to the seal assembly 100, the seal assembly 100 may begin to descend, thereby actuating one or more pressure-actuated release mechanisms, such as one or more elastic levers 404, in the resettable actuator. Alternative to shear pins, the plurality of elastic levers 404 may be reused so that the seal assembly 100 may also be re-used if it has to be brought back up to the surface to reset the seal. Before actuation, the pressure-actuated release mechanisms may hold the actuator ring 102 in place. One or more radial pressure-actuated release mechanism may interface with one or more radial grooves in actuator ring 102 and thereby prevent axial movement. Similarly, one or more axial pressure-actuated release mechanisms may interface with one or more axial grooves in actuator ring 102 and thereby prevent radial movement. Once the pressure-actuated release mechanisms actuate, actuator ring 102 may rotate, thus rotating lock ring 104 and rotator ring 106 (referring to FIG. 1) below. Upon rotating, rotator ring 106 (referring to FIG. 1) may be pushed upwards by at least one ramp, such as one or more ramps 402 (referring to FIG. 4), which may be coupled to a radially inner surface of cam ring 105. Likewise, rotator ring 106 has at least one ramp portion configured to interface with the at least one ramp upon lowering of rotator ring 106 with respect to a main body of seal assembly 100 such that further lowering of rotator ring 106 causes the at least one ramp and cam ring 105 to rotate in a direction. For example, as rotator ring 106 may be pushed upwards, the lock ring 104 may be pushed upwards by rotator ring 106, thereby causing gap 130 (referring to FIG. 1) between seal assembly 100 and the upper edge of the complementary profile on the inner surface of wellhead housing 120 (referring to FIG. 1) to shrink. In particular, shears connection between actuator ring 102 and rotator ring 106 may allow the actuator to move down until it snaps into place, providing a new shoulder to support a load. Substantial removal of the seal assembly/wellhead housing gap may result in system rigidity.

In certain other embodiments, the pressure-actuated release mechanisms may couple actuator ring 102 to rotator ring 106 using a first set of levers and a second set of levers, such as elastic levers 404. For example, the first set of levers act as radial cantilever beams with a first load concentrated at the end of the radial cantilever beams and the second set of levers act as axial cantilever beams with a second load concentrated at the end of axial cantilever beams. As another example, a lever may be coupled to and extending from rotator ring 106 and a groove, such as groove 1104 (referring to FIG. 11), formed in actuator ring 102, a distal end of the lever disposed in the groove formed in actuator ring 102. As another example, a series of levers may be machined into or attached to actuator ring 102 of seal assembly 100. The series of levers may comprise two sets of levers: a first set of levers that interfaces with radial grooves on actuator ring 102, and a second set of levers that interfaces with axial grooves on actuator ring 102. Each lever may act as a cantilever beam with the load concentrated at the end of the beam. Each radial lever may be oriented horizontally or angled to optimize torque resistance; similarly, each axial lever may be oriented vertically or angled to optimize torque resistance. In certain embodiments, the grooves may have different angles to decrease torque during install and increase torque during retrieval. The levers may maintain the relative position of actuator ring 102 and rotator ring 106 until enough force is applied to unseat the lever profiles, elastically flex the levers, and allow actuator ring 102 to move and retract. Lever movement may be blocked until rotator ring 106 is positioned to rotate, preventing premature disengagement. For example, the resettable actuator may force a lever coupled to the rotator ring 106 to flex such that a distal end of the lever extending from the rotator ring 106 moves out of a groove formed in the resettable actuator.

In certain embodiments, the pressure-actuated release mechanisms may comprise shear pins or shear keys. A target pressure may be applied by gravity alone, by a non-gravitational force, or by gravity in conjunction with a non-gravitational force. One or more shear pins may be disposed at one or more appropriate locations so as to rotationally lock one or more rings until a sufficient pressure is applied. Once the target pressure is met (that is, once the shear pin's yield strength is exceeded), one or more shear pins may be broken, thereby allowing the one or more rings to rotate. Therefore, it may require replacement of the shear pins before seal assembly 100 may be reused. However, the use of shear pins may be inefficient and imprecise. Each time a shear pin is broken, seal assembly 100 must be at least partially disassembled, and a new shear pin must be provided. Shear pins actuate when the pin's yield strength is exceeded. However, yield strength can vary due to several factors, such as temperature, prior plastic deformation, or fatigue. Such unpredictability decreases the reliability of the overall seal assembly system 100. Therefore, it is very desired to develop seal assembly system 100 for efficiently locking casing hanger 122 to wellhead housing 120 without the use of shear pins.

In the seal assembly 100 of FIGS. 3 and 4, lock ring 104 may mate with lockdown sleeve 112 (referring to FIG. 1) and wellhead housing 120 (referring to FIG. 1). Spaceout indicator ring 114 (referring to FIG. 1) may expand radially through a space in cam ring 105 to keep lock ring 104 from fully setting the seal until it is in position to do so. In an embodiment, the spaceout indicator ring 114 (referring to FIG. 1) may not snap into wellhead until lock ring 104 reaches the appropriate place; then, once lock ring 104 is in proper position, the spaceout indicator ring 114 (referring to FIG. 1) may snap out and release the lockdown sleeve 112 (referring to FIG. 1), thereby allowing the lockdown sleeve 112 (referring to FIG. 1) to progress downward.

The rigidized wellhead indicator system of FIGS. 1-4 embodies several advantages. By disallowing the spaceout indicator ring 114 (referring to FIG. 1) from fully expanding through the space in cam ring 105 until lock ring 104 has rigidized the wellhead system, an operator may be given an indication of whether the system is rigidized. If the system is not rigidized, the seal assembly 100 will be pulled out of the wellhead with the running tool when the running tool is removed. If the system is rigidized, the seal assembly 100 will remain locked to the wellhead housing when the running tool is removed. This confirmation of rigidity decreases the risk of user error and the risk of allowing a gap to remain between the seal assembly 100 and wellhead housing 120 (referring to FIG. 1). If the gap 130 (referring to FIG. 1) is allowed to persist, axial movement between the seal assembly 100 and wellhead housing 120 (referring to FIG. 1) may eventually cause fatigue and system failure.

Figure 5A:
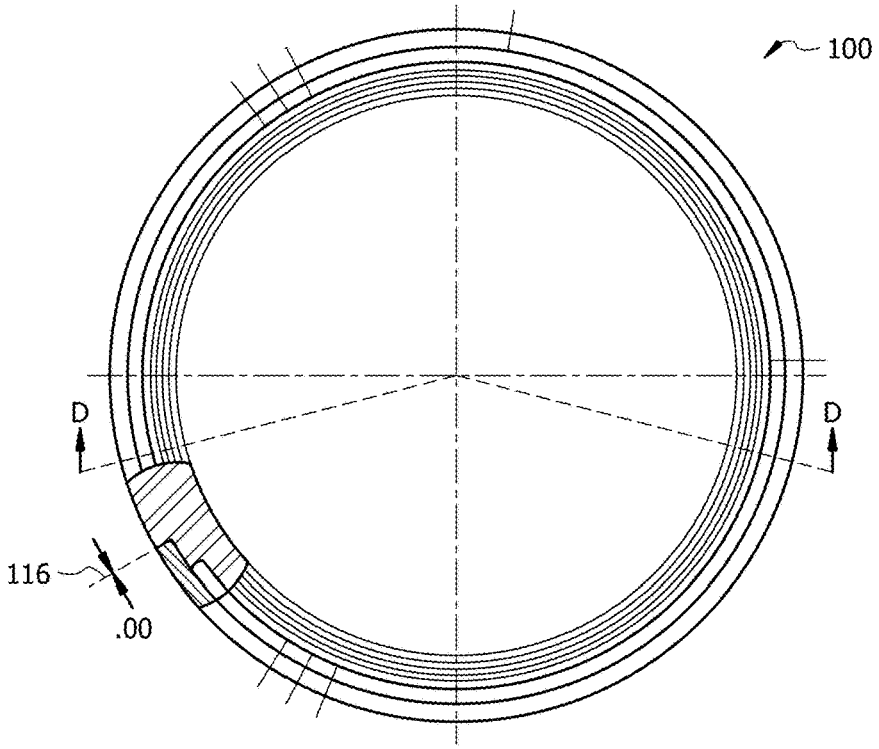
FIGS. 5A, 5B, and 5C illustrate partial cutaway views of a wellhead system having a seal assembly as run, according to one or more embodiments.
Figure 5B:
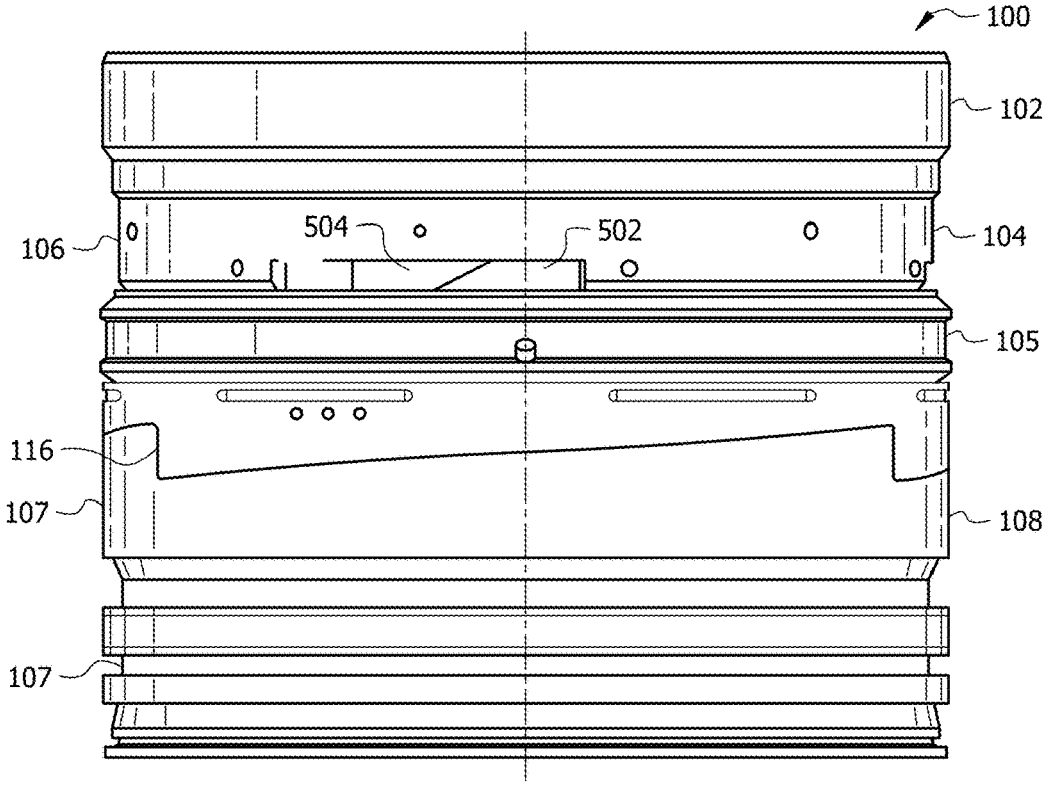
Figure 5C:
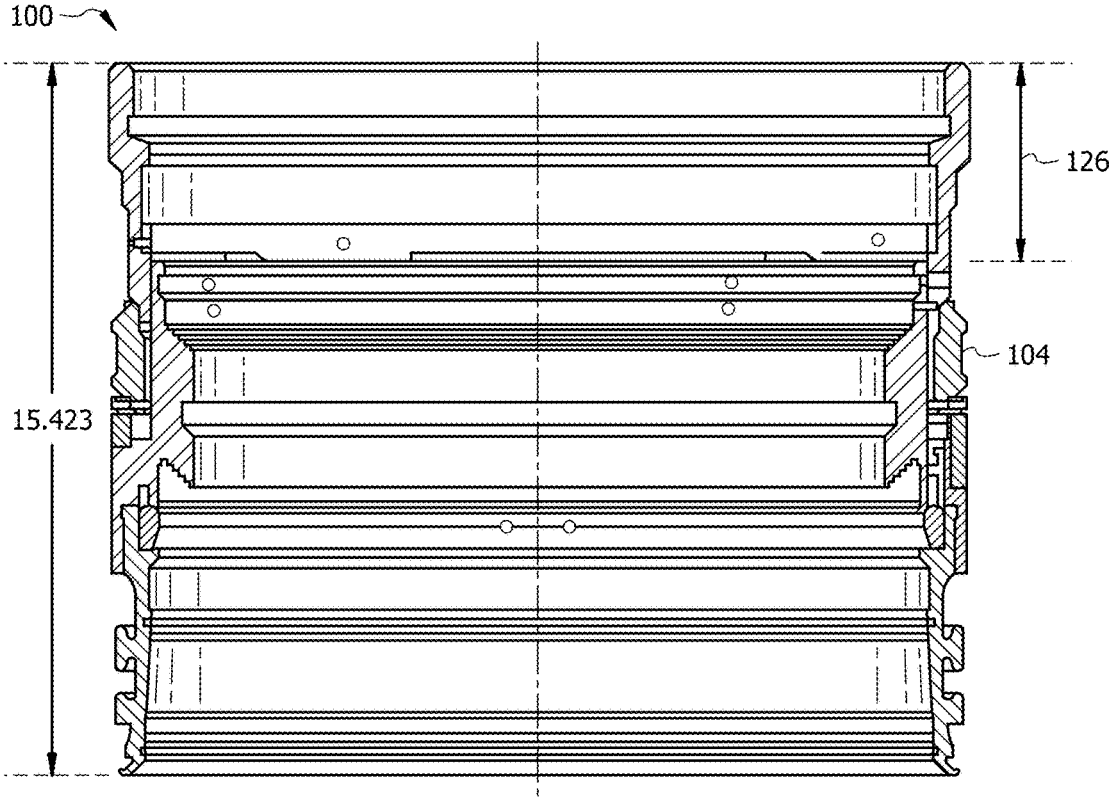

FIGS. 5A, 5B, and 5C illustrate partial cutaway views of a wellhead system having a seal assembly 100 as run, according to one or more embodiments. FIG. 5A depicts a top view of seal assembly 100 as run interfacing with an internal surface of wellhead housing 120 (referring to FIG. 1). Seal 107 (referring to FIG. 5B) may be set and radial gap 116 may be zero between cam ring 105 (referring to FIG. 5B) and seal 107 (referring to FIG. 5B) for seal assembly 100 as run. Seal assembly 100 as run may rigidize a lock ring 104 (referring to FIG. 5B) used in annulus seal assemblies and lockdown sleeves/bushings in the oil and gas industry. FIG. 5B depicts an exterior view of the seal assembly 100 as run. Actuator ring 102 may thereby rotate lock ring 104 and cam ring 105 to push out lock ring 104. As cam ring 105 rotates, it may be lifted by one or more ramps 502 attached to cam ring 105. The one or more ramps 502 attached to cam ring 105 interface with one or more ramps 504 of rotator ring 106. Rotation of cam ring 105 may create a radial gap 116 between the upper body 108 of seal 107 and the cam ring 105. As radial gap 116 increases in size, lock ring 104 and actuator ring 102 may be pushed upwards by cam ring 105 to accommodate for the space occupied by radial gap 116. FIG. 5C depicts a cross sectional view of seal assembly 100 as run in FIG. 5A. Standoff 126 may be 4.27 inches for seal assembly 100 as run. In certain embodiments, the weight of the seal assembly 100 as run and the running tool may exert an axial force to seal assembly 100 as run. Gap 130 (referring to FIG. 1) may exist between lock ring 104 and the upper edge of the complementary profile on the inner surface of wellhead housing 120 (referring to FIG. 1). As the axial force is applied, one or more pressure-actuated release mechanisms may be actuated.

Figure 6A:
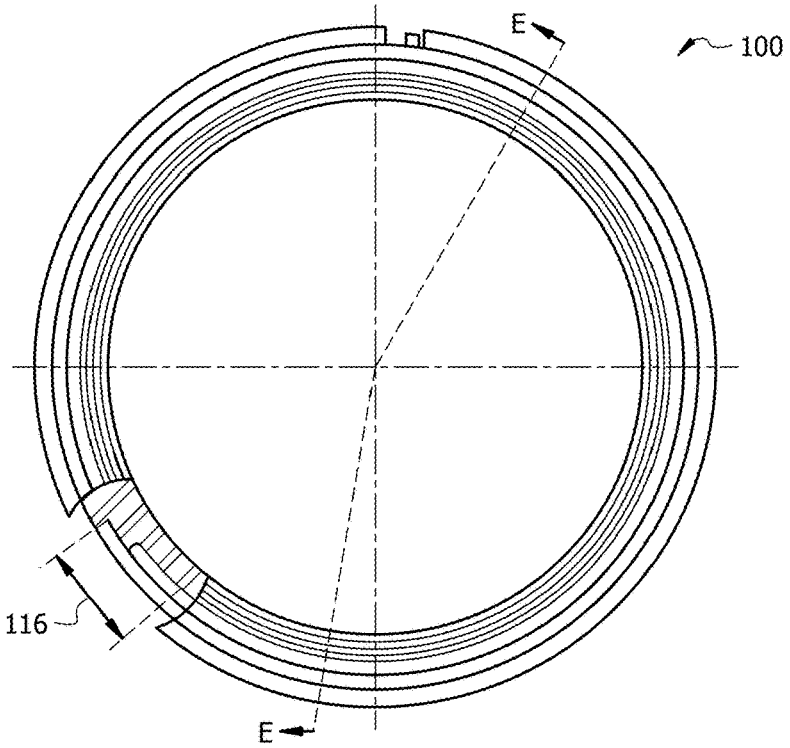
FIGS. 6A, 6B, and 6C illustrate partial cutaway views of a wellhead system having a non-rigidized seal assembly engaging a wellhead housing, according to one or more embodiments.
Figure 6B:
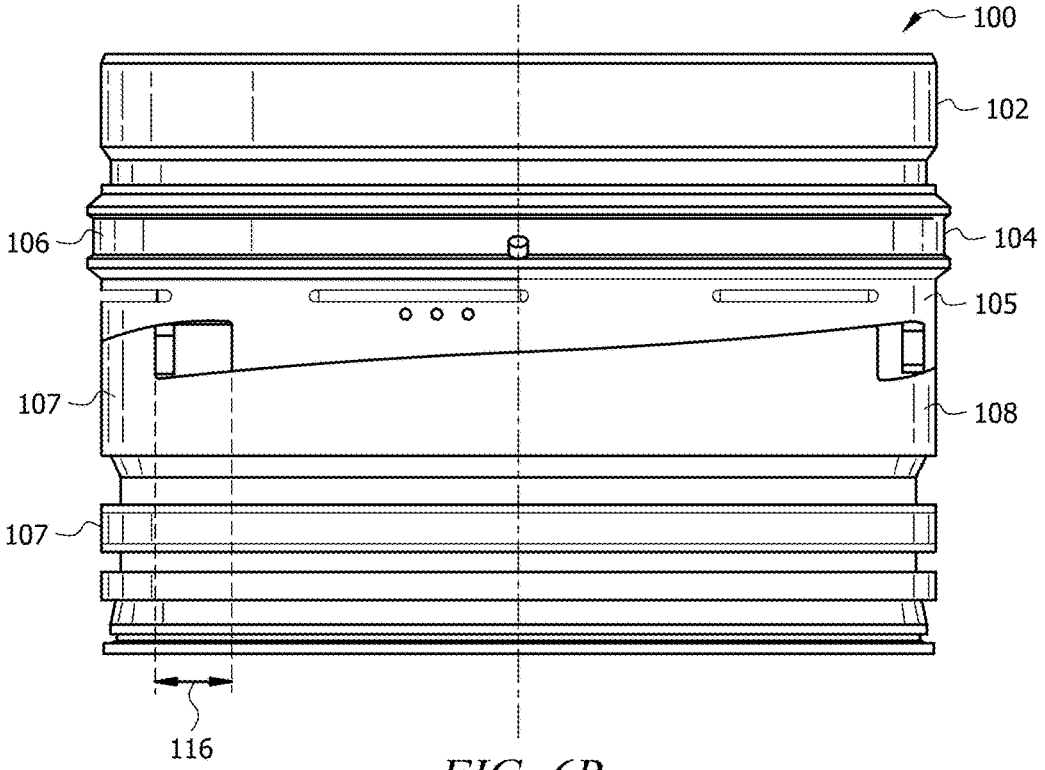
Figure 6C:
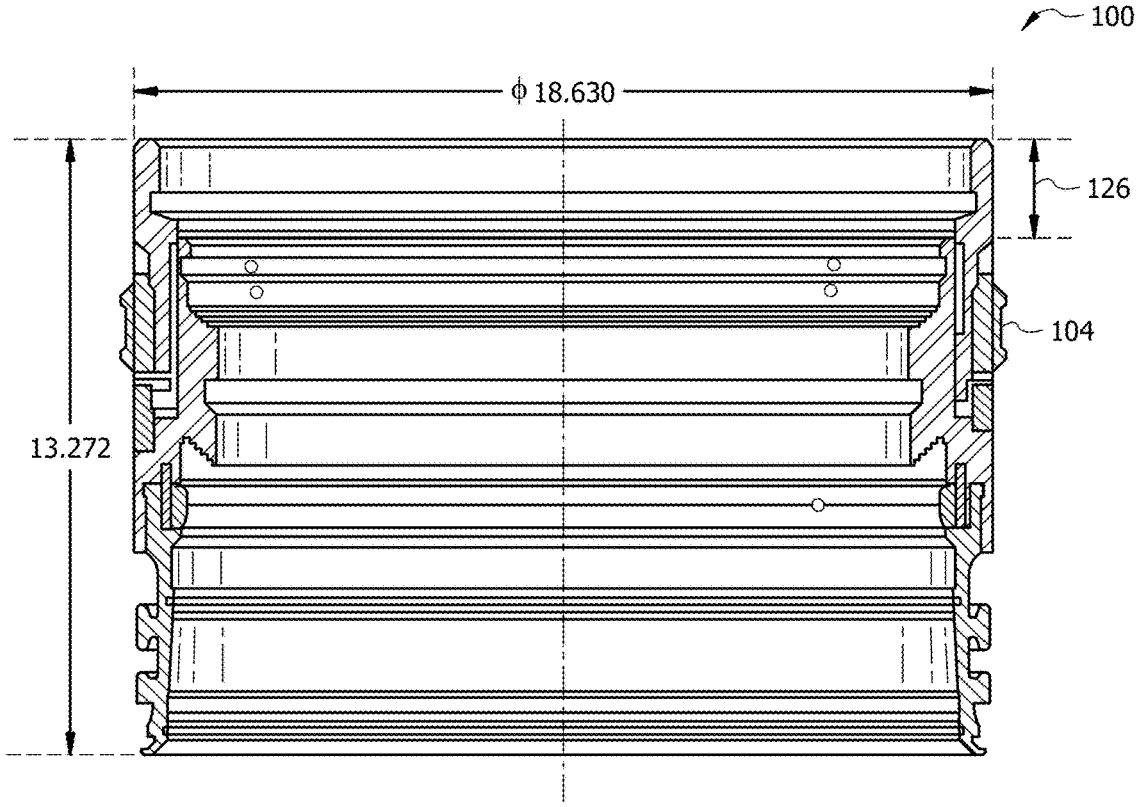

FIGS. 6A, 6B, and 6C illustrate partial cutaway views of a wellhead system having a non-rigidized seal assembly 100 engaging a wellhead housing 120 (referring to FIG. 1), according to one or more embodiments. FIG. 6A depicts a top view of the seal assembly 100 interfacing with an internal surface of wellhead housing 120 (referring to FIG. 1). Seal 107 may be set in wellhead housing 120 (referring to FIG. 1). Rotation of cam ring 105 (referring to FIG. 6B) may create a radial gap 116 of 2.67 inches between the upper body 108 (referring to FIG. 6B) of seal 107 (FIG. 6B) and the cam ring 105 (referring to FIG. 6B). Seal assembly 100 may not be rigidized and it may continue to rigidize lock ring 104 (referring to FIG. 6B). FIG. 6B depicts an exterior view of seal assembly 100. Actuator ring 102 may continue to rotate lock ring 104 and cam ring 105 to push out lock ring 104. As cam ring 105 rotates, it may be lifted by one or more ramps 502 attached to cam ring 105. The one or more ramps 502 attached to cam ring 105 interface with one or more ramps 504 of rotator ring 106. Rotation of cam ring 105 may increase radial gap 116 between the upper body 108 of seal 107 and the cam ring 105. As radial gap 116 increases in size, lock ring 104 and actuator ring 102 may be pushed upwards by cam ring 105 to accommodate for the space occupied by radial gap 116. FIG. 6C depicts a cross sectional view of seal assembly 100 in FIG. 6A. Standoff 126 may be 2.12 inches for seal assembly 100. In certain embodiments, the weight of seal assembly 100 and the running tool may exert an axial force to seal assembly 100. Gap 130 (referring to FIG. 1) may reduce between lock ring 104 and the upper edge of the complementary profile on the inner surface of wellhead housing 120 (referring to FIG. 1). As the axial force is applied, one or more pressure-actuated release mechanisms may be actuated.

Figure 7A:
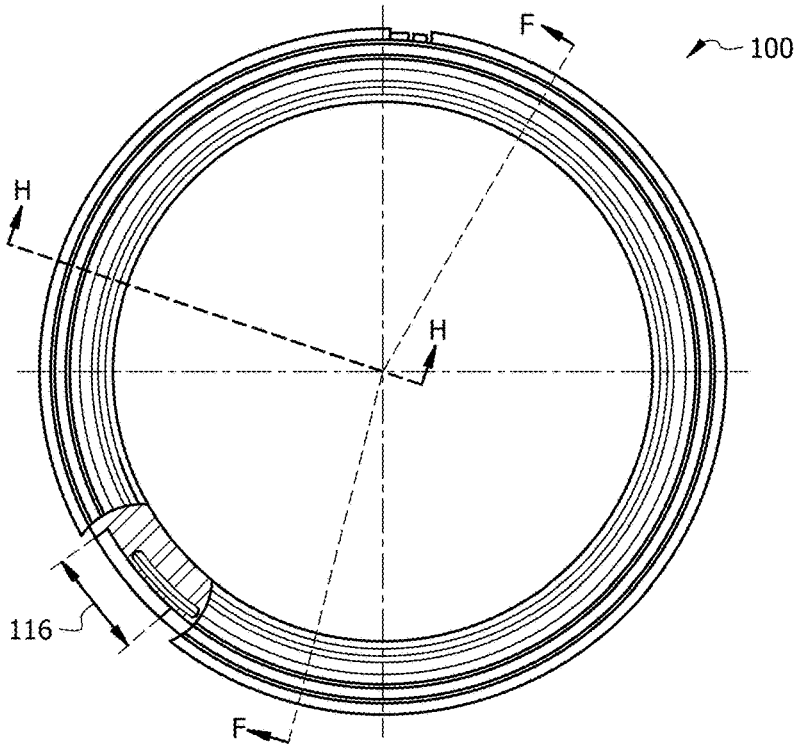
FIGS. 7A, 7B, and 7C illustrate partial cutaway views of a wellhead system having a non-rigidized seal assembly engaging a wellhead housing, according to one or more embodiments.
Figure 7B:
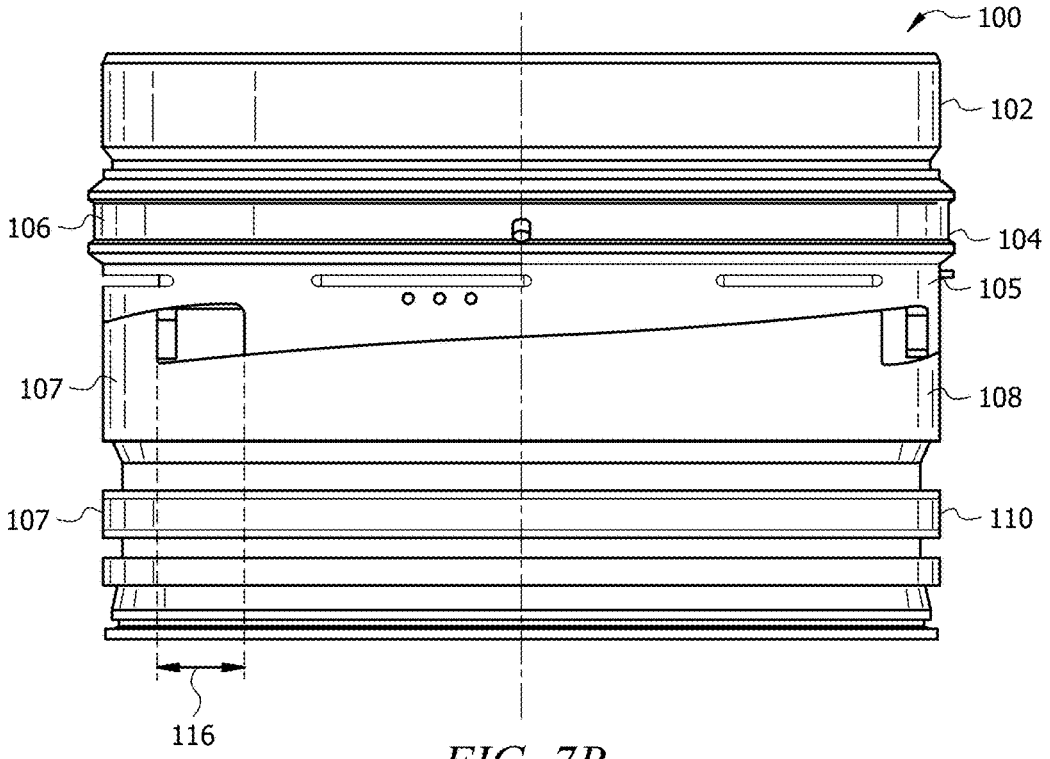
Figure 7C:
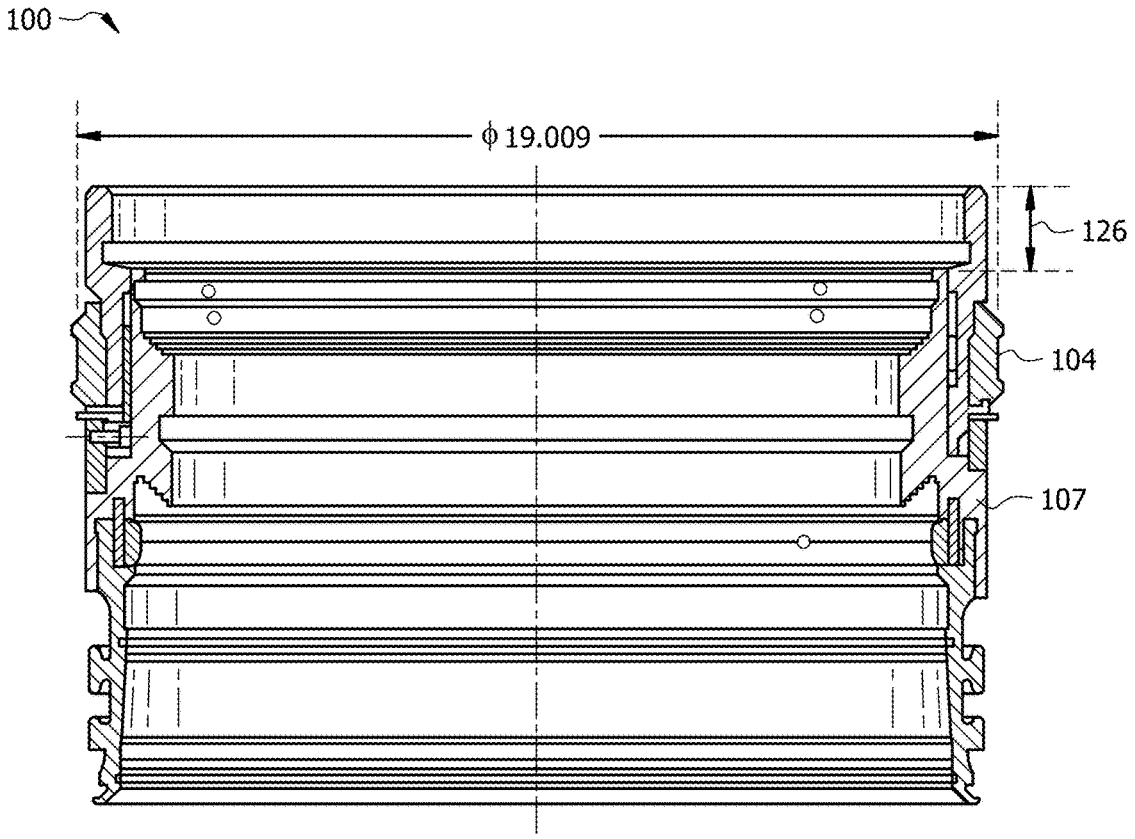

FIGS. 7A, 7B, and 7C illustrate partial cutaway views of a wellhead system having a non-rigidized seal assembly 100 engaging a wellhead housing 120 (referring to FIG. 1), according to one or more embodiments. FIG. 7A depicts a top view of seal assembly 100 interfacing with an internal surface of wellhead housing 120 (referring to FIG. 1). Seal 107 (referring to FIG. 7B) may be set in wellhead housing 120 (referring to FIG. 1). Maximal rotation of cam ring 105 (referring to FIG. 7B) may create a maximal radial gap 116 of 2.91 inches between the upper body 108 (referring to FIG. 7B) of seal 107 (referring to FIG. 7B) and the cam ring 105 (referring to FIG. 7B). Seal assembly 100 may be rigidized and may not continue to rigidize lock ring 104 (referring to FIG. 7B). FIG. 7B depicts an exterior view of the seal assembly 100. Actuator ring 102 may not continue to rotate lock ring 104 and cam ring 105 to push out lock ring 104. FIG. 7C depicts a cross sectional view of seal assembly 100 in FIG. 7A. Standoff 126 may be 1.72 inches for seal assembly 100. In certain embodiments, the weight of seal assembly 100 and the running tool may exert an axial force to seal assembly 100. Gap 130 (referring to FIG. 1) may be closed for a positive confirmation that seal 107 is rigidized between lock ring 104 and the upper edge of the complementary profile on the inner surface of wellhead housing 120. As the axial force is applied, one or more pressure-actuated release mechanisms may be actuated.

Figure 8:
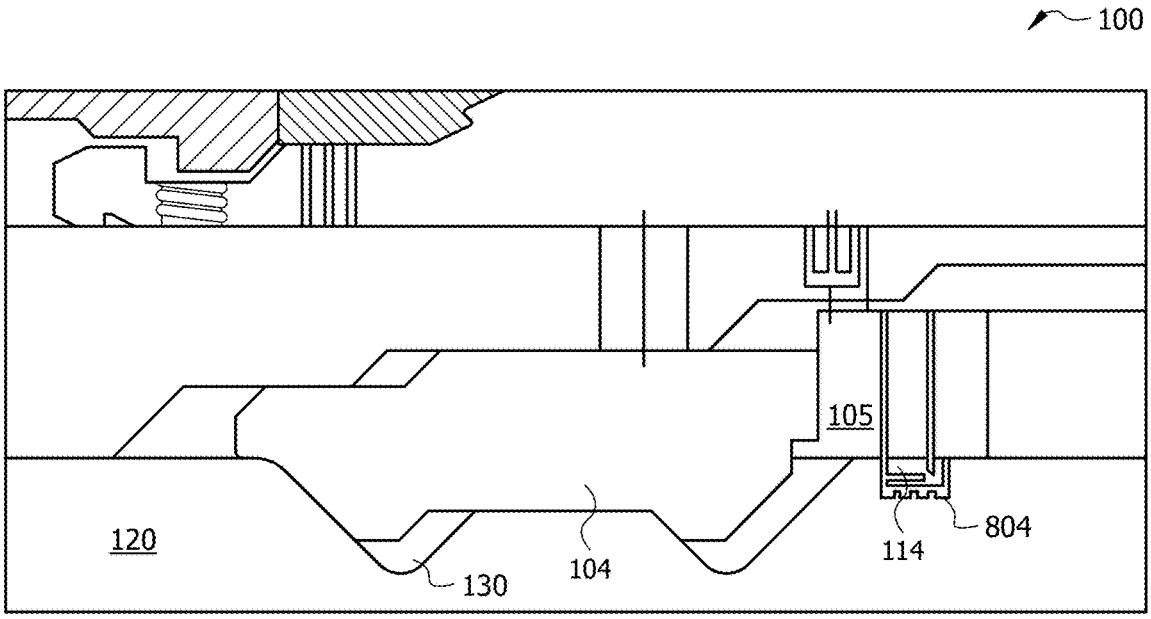
FIG. 8 illustrates a cross-sectional view of the seal assembly of FIG. 1 with a spaceout indicator ring, in accordance with an embodiment of the present disclosure.

FIG. 8 illustrates a cross-sectional view of seal assembly 100 of FIG. 1 with a spaceout indicator ring 114, in accordance with an embodiment of the present disclosure. Spaceout indicator ring 114 may engage a wellhead indicator groove 804 in wellhead housing 120 to achieve a positive confirmation that seal 107 (referring to FIG. 1) is rigidized. In certain embodiments, a position of the spaceout indicator ring 114 may indicate progression of the seal assembly 100 from (1) a running position; to (2) a locked position; to (3) a rigidized position. FIGS. 5A-5C depict views of the seal assembly 100 in a running position (that is, the position of the seal assembly 100 when first placed within the wellhead). FIGS. 6A-6C depict views of the seal assembly 100 in a locked position (that is, the position of the seal assembly 100 when engaged with the wellhead housing 120 (referring to FIG. 1) but not yet rigidized). FIGS. 7A-7C, and 8 depict views of the seal assembly 100 in a rigidized position (that is, the final position of the seal assembly 100 in a rigidized wellhead system).

The running position of FIGS. 5A-5C may be reached when the seal assembly 100 is landed on the casing hanger 122 (referring to FIG. 1). As an axial force is applied to the seal assembly 100, one or more pressure-actuated release mechanisms may be actuated, thereby allowing actuator ring 102 to move and rotate. Progression of the actuator ring 102's rotation may cause the seal assembly 100 to progress from the running position of FIGS. 5A-5C to the locked position of FIGS. 6A-6C to the rigidized position of FIGS. 7A-7C, and 8. Rotation of actuator ring 102 (referring to FIG. 1) may cause lock ring 104, cam ring 105, and rotator ring 106 (referring to FIG. 1) to rotate. As cam ring 105 rotates, it may be lifted by one or more ramps. Rotation of cam ring 105 may cause radial gap 116 (referring to FIG. 7B) between seal 107 (referring to FIG. 7B) and cam ring 105 to grow. In certain embodiments, radial gap 116 (referring to FIG. 5B) may be substantially nonexistent in the running position of FIGS. 5A-5C. In certain embodiments, radial gap 116 (referring to FIG. 7B) may reach its largest size in the rigidized position of FIGS. 7A-7C, and 8. As radial gap 116 (referring to FIG. 7B) increases in size, lock ring 104 and actuator ring 102 (referring to FIG. 1) may be pushed upwards by cam ring 105 to accommodate for the space occupied by radial gap 116 (referring to FIG. 7B). The inversely corresponding gap 130 (referring to FIG. 1) between lock ring 104 and the upper edge of the complementary profile on the inner surface of the wellhead housing 120 (referring to FIG. 1) may thereby shrink, ultimately rigidizing the system and arriving at the position of FIGS. 7A-7C, and 8.

FIG. 9 illustrates a cross-sectional view of the seal assembly 100 of FIG. 1 with the spaceout indicator ring 114 in a first position indicating that the seal 107 (referring to FIG. 1) is not rigidized, in accordance with an embodiment of the present disclosure. When spaceout indicator ring 114 does not engage wellhead indicator groove 804 (referring to FIG. 8), lockdown sleeve 112 (referring to FIG. 1) may be blocked from a full stroke to expand lock ring 104 (referring to FIG. 1) into a mating groove, such as wellhead indicator groove 804 (referring to FIG. 8), in wellhead housing 120 (referring to FIG. 1). Thus, gap 130 (referring to FIG. 1) may exist and lock ring 104 (referring to FIG. 1) does not engage casing hanger 122 (referring to FIG. 1). Seal assembly 100 may return on the running tool and seal 107 (referring to FIG. 1) is not rigidized.

Figure 10:
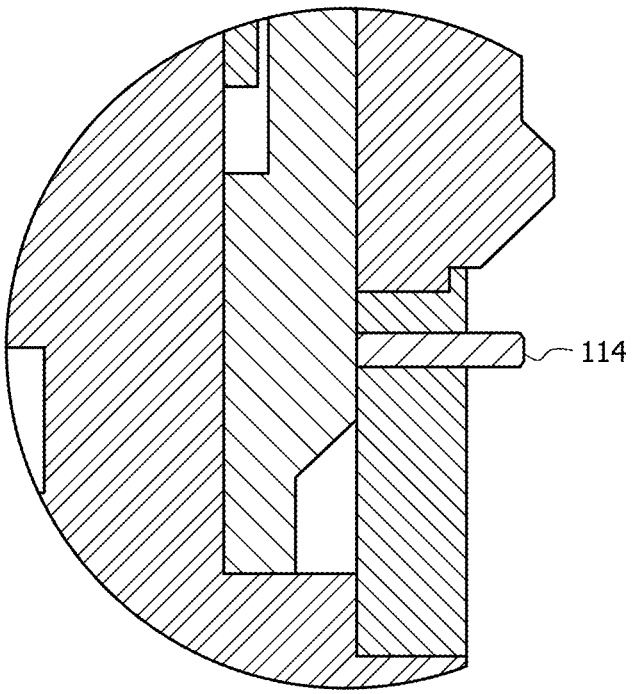
FIG. 10 illustrates a cross-sectional view of the seal assembly of FIG. 1 with the spaceout indicator ring in a second position indicating the seal is rigidized, in accordance with an embodiment of the present disclosure.

FIG. 10 illustrates a cross-sectional view of the seal assembly 100 of FIG. 1 with the spaceout indicator ring 114 in a second position indicating that the seal 107 (referring to FIG. 1) is rigidized, in accordance with an embodiment of the present disclosure. When spaceout indicator ring 114 engages wellhead indicator groove 804 (referring to FIG. 8), lockdown sleeve 112 (referring to FIG. 1) may travel the full stroke to expand lock ring 104 (referring to FIG. 1) into a mating groove, such as wellhead indicator groove 804 (referring to FIG. 8), in wellhead housing 120 (referring to FIG. 1). Thus, gap 130 (referring to FIG. 1) may not exist and lock ring 104 (referring to FIG. 1) may engage casing hanger 122 (referring to FIG. 1). Seal 107 (referring to FIG. 1) may be rigidized in wellhead housing 120 (referring to FIG. 1).

Figure 11:
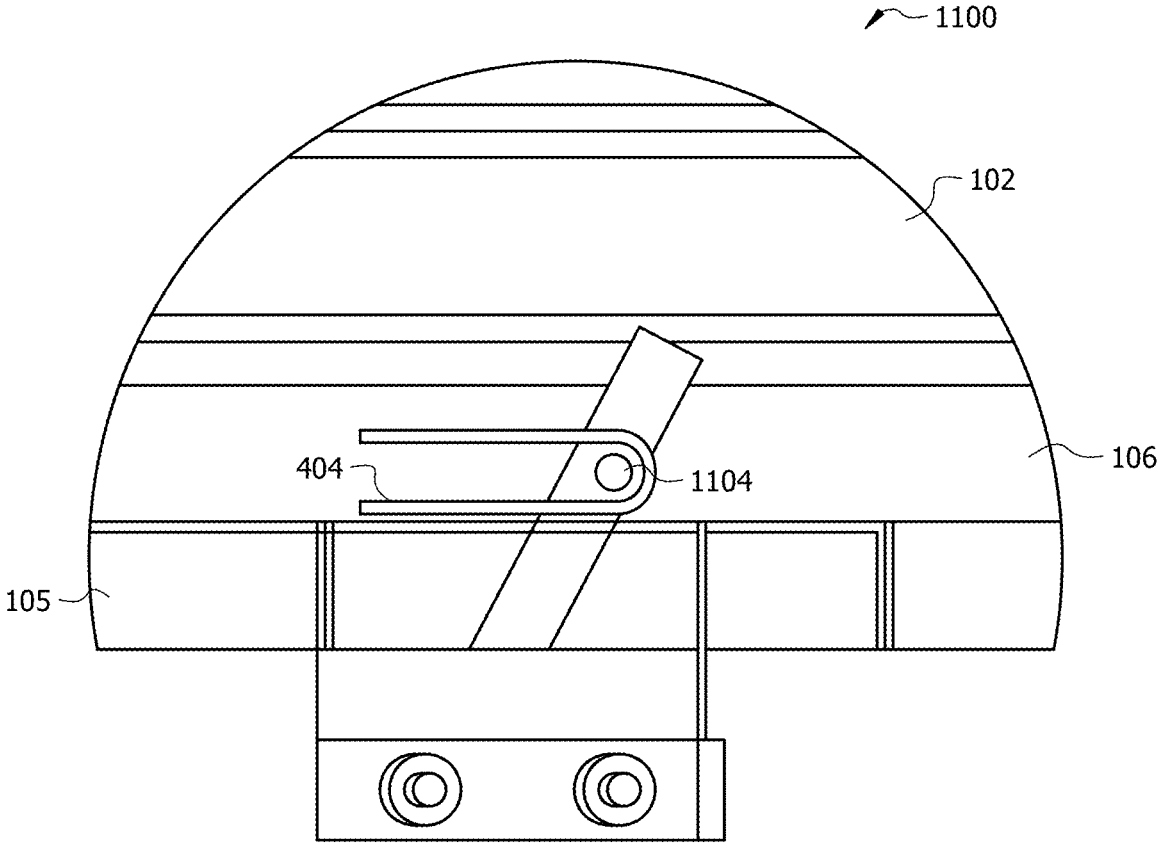
FIG. 11 illustrates a partial cutaway view of a resettable actuator that may be used with the seal assembly of FIG. 1, in accordance with an embodiment of the present disclosure.

FIG. 11 illustrates a partial cutaway view of a resettable actuator 1100 that may be used with the seal assembly 100 of FIG. 1, in accordance with an embodiment of the present disclosure. Resettable actuator 1100 may implement a rigidizing mechanism for the seal assembly 100 to function without shear pins, keys, or other breakable device. In particular, FIG. 11 depicts a seal assembly 100 having an elastic lever 404, according to one or more embodiments. The elastic lever 404 may be coupled to and extending from the rotator ring 106 and a groove, such as groove 1104, formed in the actuator ring 102, a distal end of the lever disposed in the groove formed in the actuator ring 102. As an axial force is applied to a seal assembly 100, seal assembly 100 may begin to descend, thereby actuating one or more pressure-actuated release mechanisms. One traditional pressure-actuated release mechanism may be a shear pin. When sufficient force is applied to a shear pin, the shear pin breaks, thereby allowing movement of a corresponding component of the system. In certain embodiments, breaking of a shear pin may allow the actuator ring 102 to rotate.

Shear pins are inefficient and imprecise. Each time a shear pin is broken, the seal assembly 100 needs to be at least partially disassembled, and a new shear pin needs to be provided. Furthermore, because shear pin actuation relies upon the shear pin's yield strength, shear pin actuation inherently depends upon factors such as temperature, prior plastic deformation, and fatigue. Accordingly, FIG. 11 depicts an elastic lever 404 rather than a shear pin. One or more clastic levers 404 may be machined into or attached to rotator ring 106 of the seal assembly 100. For example, the set of elastic levers 404 may act as radial cantilever beams with the load concentrated at the end of the beam. The end of each elastic lever 404 may have a profile that mates with a radial groove on actuator ring 102 and may be oriented vertically or angled to optimize torque resistance. Further, the radial grooves may have different angles to cause lesser torque during install and greater torque during retrieval. Elastic levers 404 may maintain the relative position of cam ring 105 until sufficient force is applied to unseat and elastically flex elastic levers 404, thereby allowing rotator ring 106 to move and retract.

As another example, the set of elastic levers 404 may act as axial cantilever beams with the load concentrated at the end of the beam. The end of each elastic lever 404 may have a profile that mates with an axial groove on the actuator ring 102 and may be oriented vertically or angled. Elastic levers 404 may maintain the relative rotational position of cam ring 105 until sufficient force is applied to unseat and elastically flex elastic levers 404, thereby allowing cam ring 105 to rotate and retract. Movement may be blocked until rotator ring 106 is positioned to rotate, preventing premature disengagement. This two-stage action may allow rotator ring 106 to rotate cam ring 105 until it reaches a specified load, then release from cam ring 105 and continue travelling to the end of the running tool stroke.

During retrieval of the seal assembly 100 still attached to the running tool, rotator ring 106 may be retracted and may not interfere with operations. During retrieval of the seal assembly 100 not attached to the running tool, landing the running tool may retract rotator ring 106 and may not interfere with operations. This arrangement relies on the elasticity of the material (a relative constant), not the yield strength of the material; thus, the force to unseat elastic lever 404 may be much more consistent than a shear pin or shear key. Furthermore, elastic levers 404 may be automatically reset and the seal assembly 100 may be rerun without disassembly and retrieving the remnants of sheared pins or keys. Elastic lever 404 may comprise any suitable elastic materials.

Accordingly, elastic lever 404 depicted in FIG. 11 and described above may be used in conjunction with one or more elements of the seal assembly 100 depicted in FIGS. 1-4. Alternatively, elastic lever 404 depicted in FIG. 11 may be used in any other application in which a shear pin could be used. Furthermore, though the systems of FIGS. 1-4 may utilize one or more clastic levers 404, they may also include one or more shear pins, either alone or in combination with the one or more elastic levers 404. It is within the ability of one skilled in the art having the benefit of the present disclosure to determine how to combine elements of the present disclosure. Those skilled in the art having the benefit of the present disclosure may elect to utilize one or more shear pins, one or more elastic levers 404, or both with the seal assembly 100 of FIGS. 1-4. Furthermore, those skilled in the art having the benefit of the present disclosure may elect to utilize one or more elastic levers 404 in the seal assembly 100 of FIGS. 1-4 or in any other application in which a shear pin could be used. Additionally, the spaceout indicator ring 114 of FIGS. 8-10 may be utilized alone or in conjunction with one or more of the seal assembly 100 of FIGS. 1-4 and the elastic lever 404 of FIG. 11.

Figure 12:
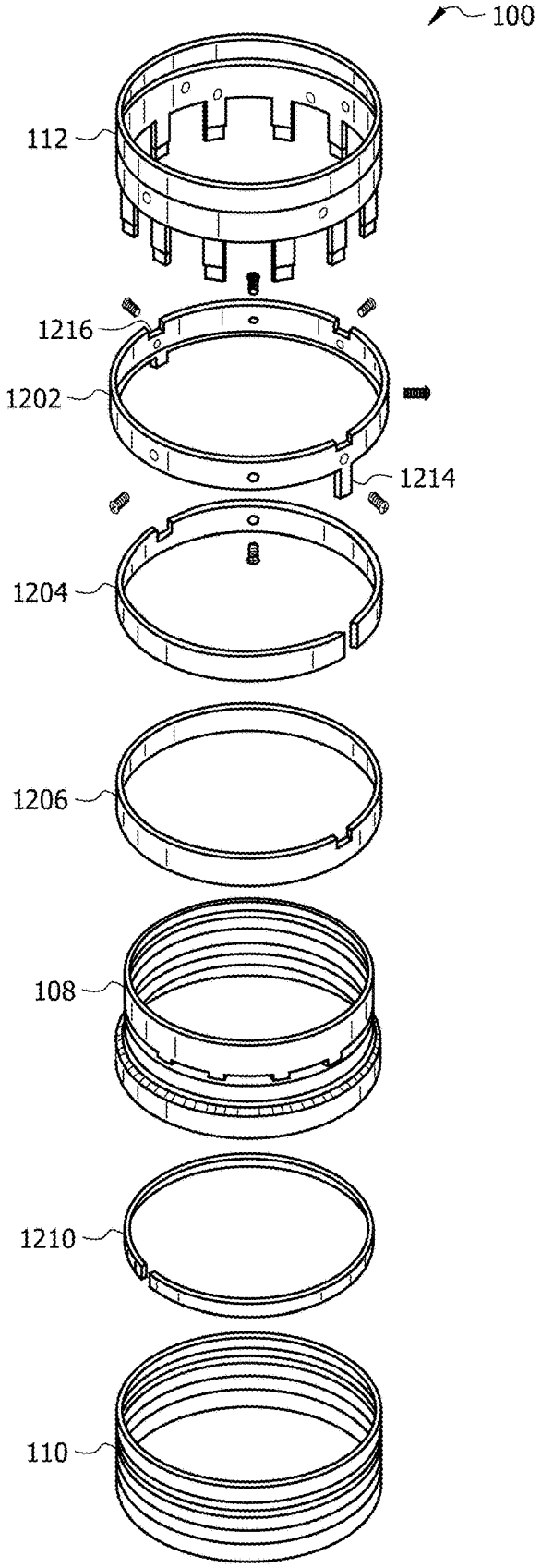
FIG. 12 illustrates an exploded view of the seal assembly of FIG. 1, in accordance with an embodiment of the present disclosure.

FIG. 12 illustrates an exploded view of the seal assembly 100 of FIG. 1, in accordance with an embodiment of the present disclosure. In particular, the seal assembly 100 may include a plurality of components, such as lockdown sleeve 112, torque ring 1202, external lock ring 1204, lock ring carrier 1206, upper body 108, inner lock ring 1210, and lower body 110. Seal assembly 100 may implement a locking mechanism for elevating and rigidizing a lockdown ring, such as external lock ring 1204, used in annulus seal assemblies and lockdown sleeves/bushings. Lock ring carrier 1206 may be attached to the external lock ring 1204 to secure the seal assembly in place. Inner lock ring 1210 may be positioned between the upper body 108 and the lower body 110 to secure the seal. The locking mechanism may be associated with a torque ring, a lockdown ring, a threaded adjustment ring, a threaded body, and an actuating mandrel. When the actuating mandrel is stroked, the lockdown ring may be expanded radially outward into a profile, such as mating groove, on an inner diameter of the wellhead housing 120 (referring to FIG. 8). Thus, gap 130 (referring to FIG. 8) may be generated between the lockdown ring and the upper edge of the complementary profile on the inner surface of wellhead housing 120.

In some embodiments, torque ring 1202 may be configured to be rotated and torqued to close gap 130 between the lockdown ring and the upper edge of the complementary profile on the inner surface of wellhead housing 120. Torque ring 1202 include two tabs, such as tab A 1214 and tab B 1216, to transfer the torque. A first tab, such as tab A 1214, may be longer and extend through a split in the lockdown ring to interface directly with the threaded adjustment ring. A second tab, such as tab B 1216, may be shorter and interface with a mating slot in the lockdown ring opposite from its split. The second tab may apply torque to the lockdown ring which transfers this torque to a tab on the threaded adjustment ring. Tab A 1214 and Tab B 1216 ensure that torque may be transferred at two points, 180 degrees apart on the threaded adjustment ring. The threaded adjustment ring rotates and elevates on a helix block relative to the threaded body. Furthermore, tabs and slots may be switched between the mating parts of the seal assembly 100. Likewise, seal assembly 100 may include a cam or ramp surface instead of a thread between the threaded adjustment ring and the threaded body.

Figure 13A:
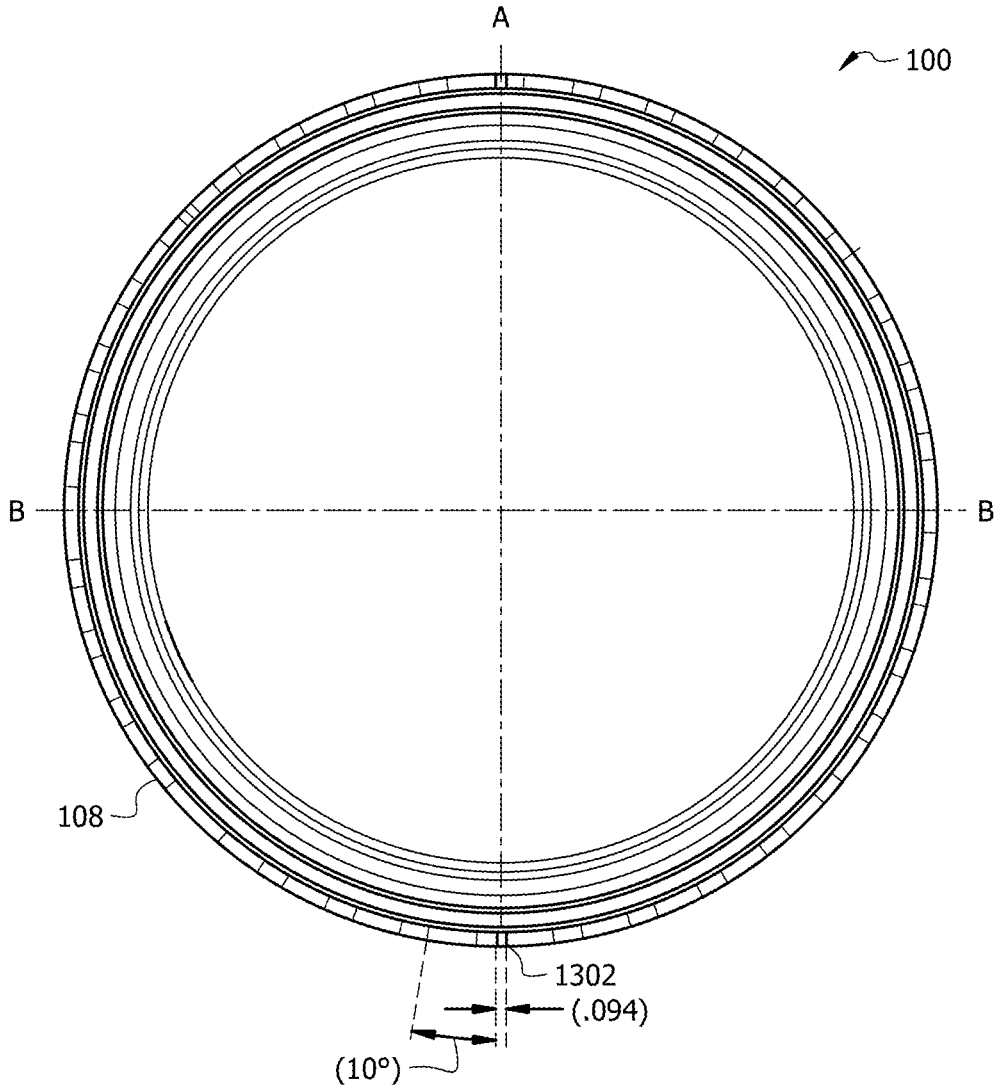
FIGS. 13A-13C illustrate perspective views of the seal assembly with a torque ring, an external lock ring, a lock ring carrier, and a lower body, in accordance with an embodiment of the present disclosure.
Figure 13B:
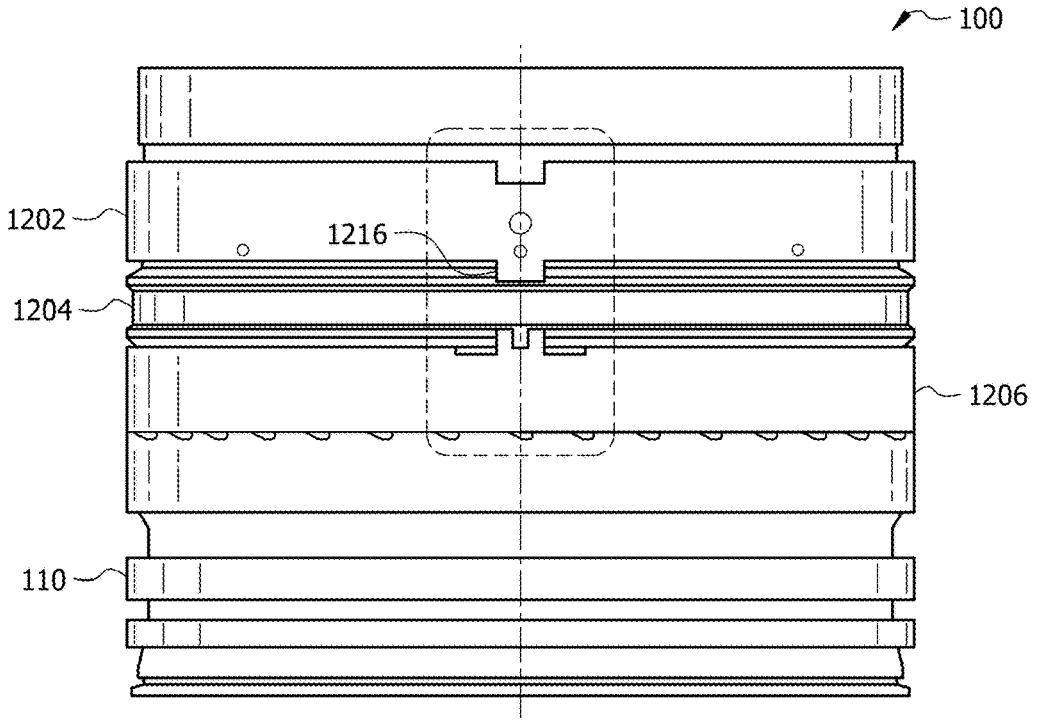
Figure 13C:
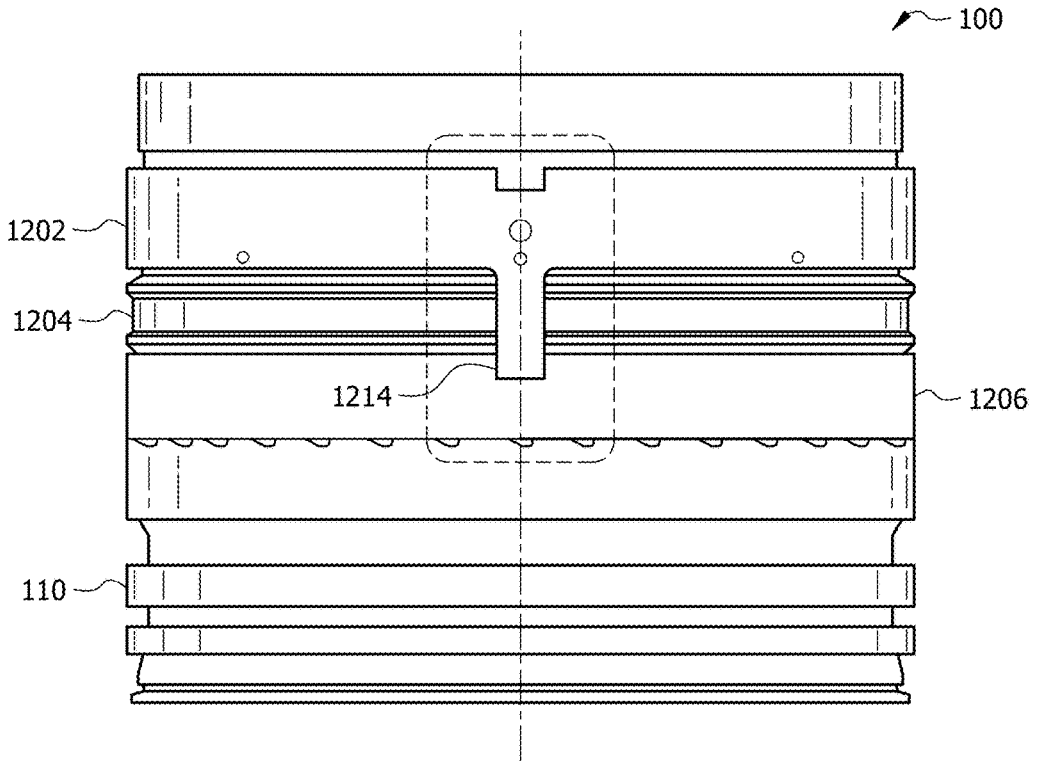

FIGS. 13A-13C illustrate perspective views of the seal assembly 100 with torque ring 1202, external lock ring 1204, lock ring carrier 1206, and lower body 110, in accordance with an embodiment of the present disclosure. FIG. 13A illustrates a top view of the seal assembly 100 with a A-A section and a B-B section taken 90 degrees apart from each other. Seal assembly 100 may comprise an anti-rotation pin 1302 attached to the upper body 108 along the A-A section. FIG. 13B illustrates a perspective view of the seal assembly 100 along the A-A section. In particular, tab B 1216 extends through a split in external lock ring 1204. Torque ring 1202 may be configured to be rotated and torqued to apply torque to external lock ring 1204, lock ring carrier 1206, and lower body 110. FIG. 13C illustrates a perspective view of the seal assembly 100 along the B-B section. In particular, tab A 1214 extends through a split in external lock ring 1204. Torque ring 1202 may be configured to be rotated and torqued to apply torque to external lock ring 1204, lock ring carrier 1206, and lower body 110.

Figure 14B:
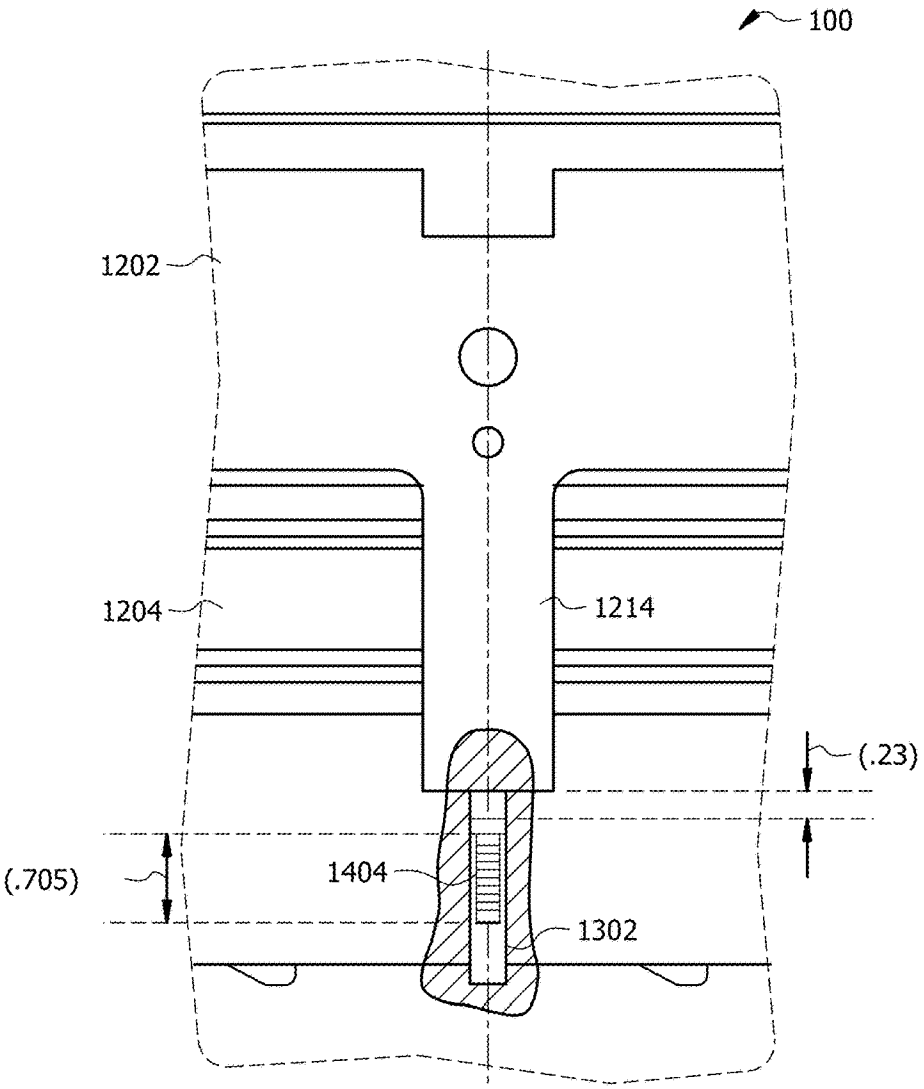
FIGS. 14A-14C illustrate perspective and cutaway views of the seal assembly of FIGS. 13B and 13C, in accordance with an embodiment of the present disclosure.
Figure 14A:
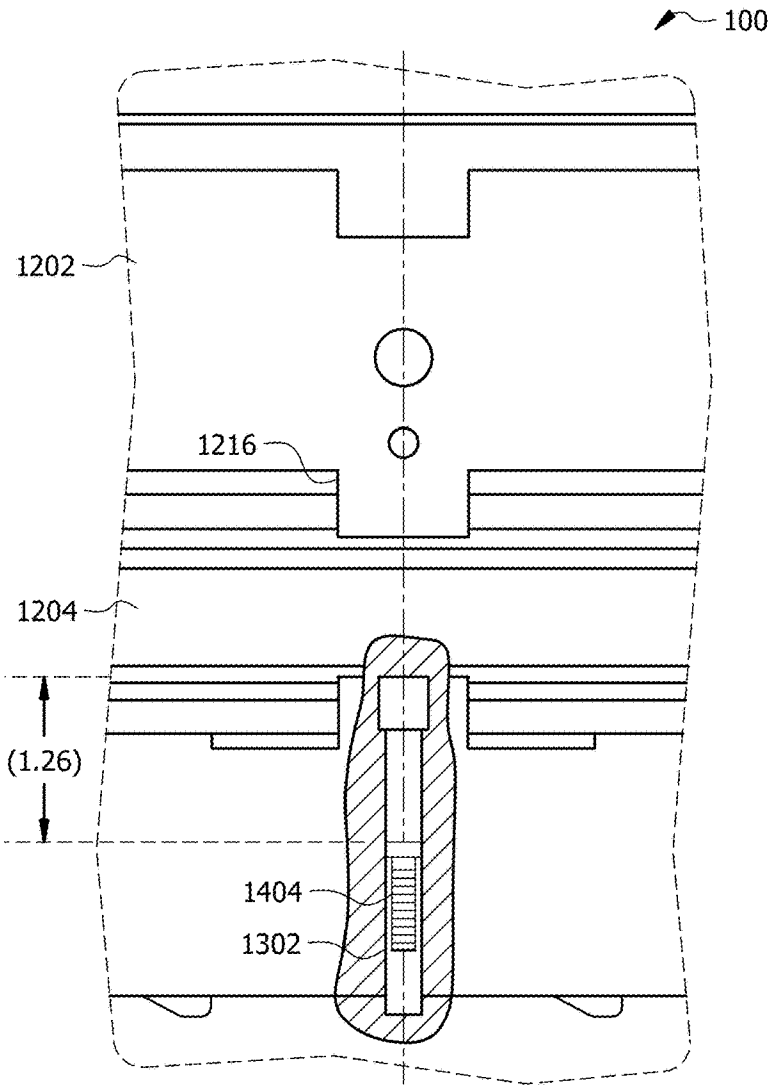
Figure 14C:
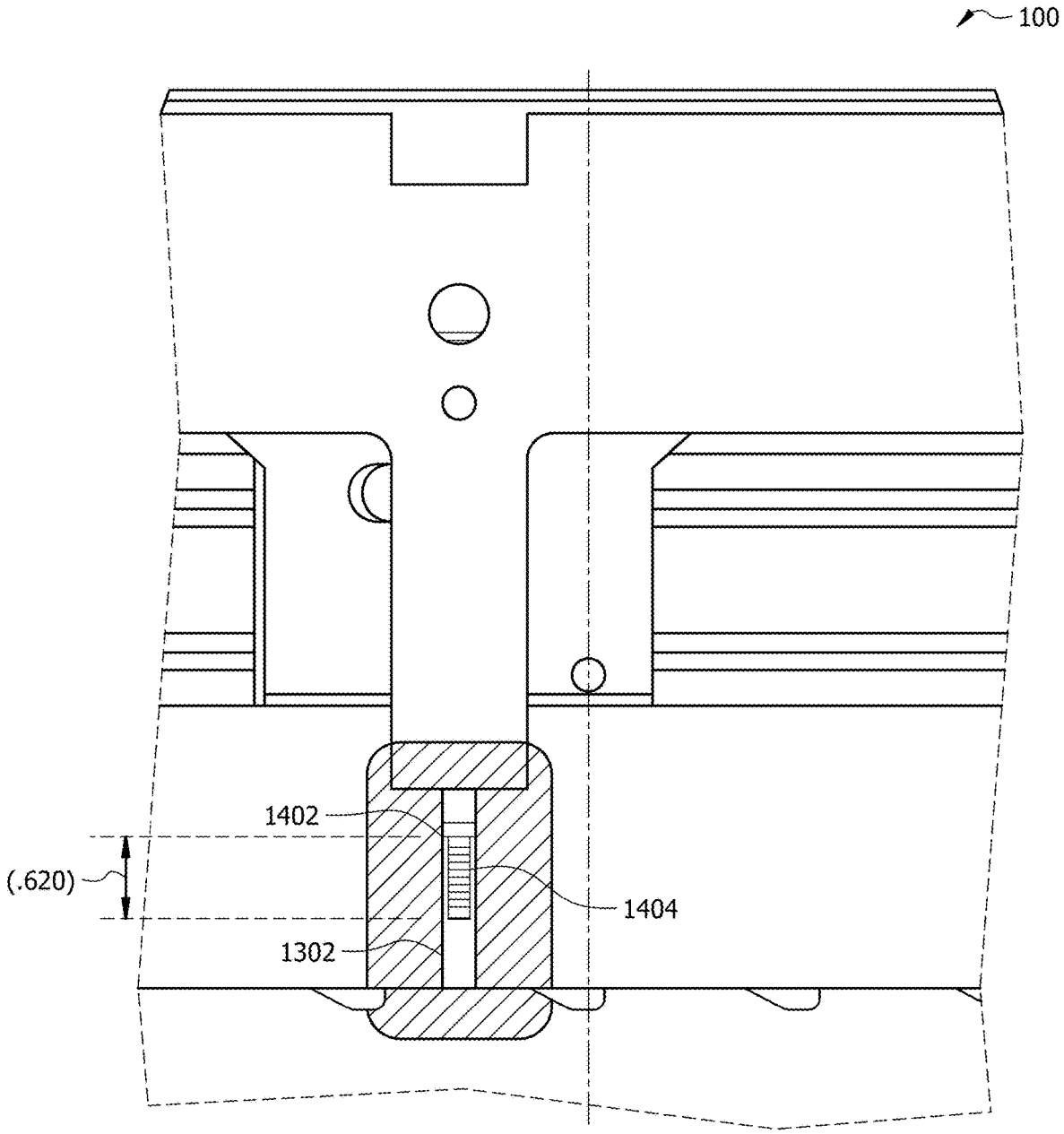

FIGS. 14A-14C illustrate perspective and cutaway views of the seal assembly 100 of FIGS. 13B and 13C, in accordance with an embodiment of the present disclosure. FIG. 14A illustrates a cutaway view of the seal assembly 100 around tab B 1216 of FIG. 13B when external lock ring 1204 is in an unlocked position. Torque ring 1202 may not be rotated and torqued with respect to external lock ring 1204, lock ring carrier 1206 (referring to FIG. 13B), and lower body 110 (referring to FIG. 13B). As a result, tab B 1216 extends through a split in external lock ring 1204. Thus, spring 1404 may be loaded and anti-rotation pin 1302 indicates external lock ring 1204 may be in an unlocked position. FIG. 14B illustrates a cutaway view of the seal assembly 100 around tab A 1214 of FIG. 13C when external lock ring 1204 is in an unlocked position. Torque ring 1202 may not be rotated and torqued with respect to external lock ring 1204, lock ring carrier 1206, and lower body 110. As a result, tab A 1214 extends through a split in external lock ring 1204. Thus, spring 1404 may be loaded and anti-rotation pin 1302 indicates external lock ring 1204 may be in an unlocked position. FIG. 14C illustrates a cutaway view of the seal assembly 100 around tab A 1214 of FIG. 13C when external lock ring 1204 is in a locked position. Torque ring 1202 (referring to FIG. 14A) may be configured to work with screw 1402, spring 1404, and anti-rotation pin 1302 to rotate by 6 degrees to apply torque to external lock ring 1204 (referring to FIG. 14A), lock ring carrier 1206 (referring to FIG. 13B), and lower body 110 (referring to FIG. 13B). As a result, tab A 1214 (referring to FIG. 14A) extends through a split in external lock ring 1204 (referring to FIG. 14A). Thus, spring 1404 may be loaded and anti-rotation pin 1302 indicates external lock ring 1204 (referring to FIG. 14A) is in locked position.

Figure 15A:
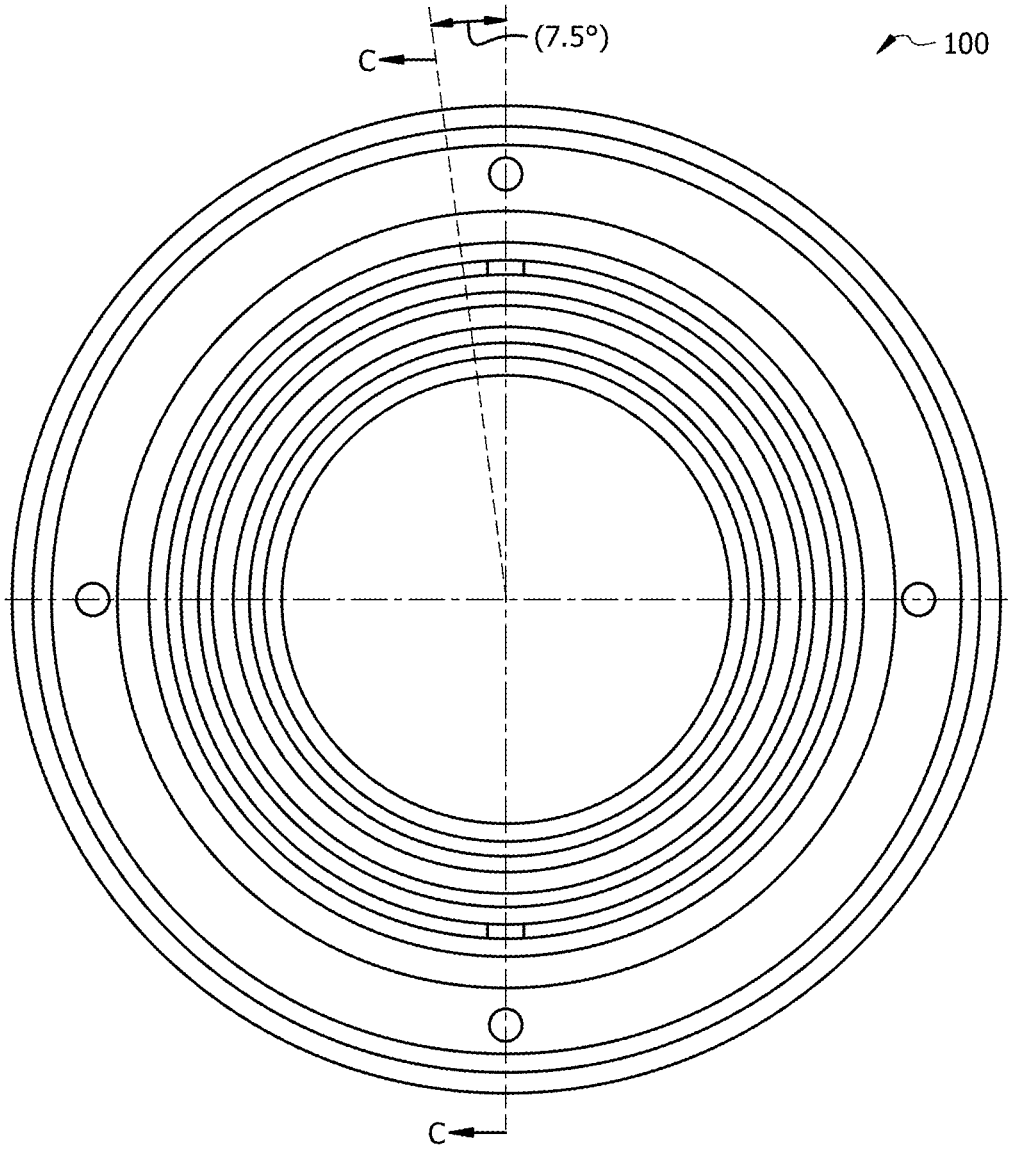
FIGS. 15A-15C illustrate perspective views of the seal assembly with an unlocked external lock ring and inner lock ring, in accordance with an embodiment of the present disclosure.
Figure 15C:
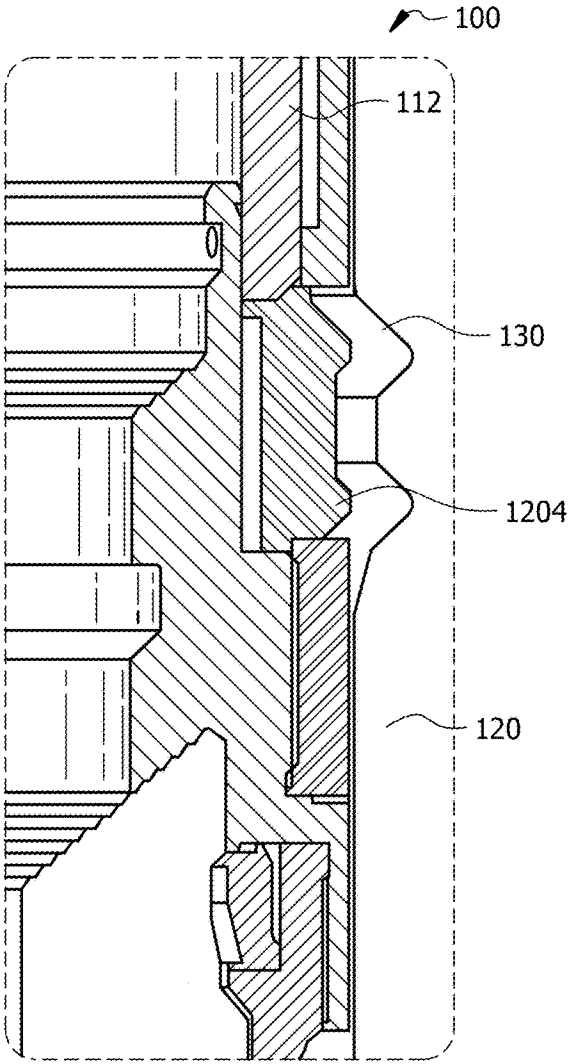
Figure 15B:
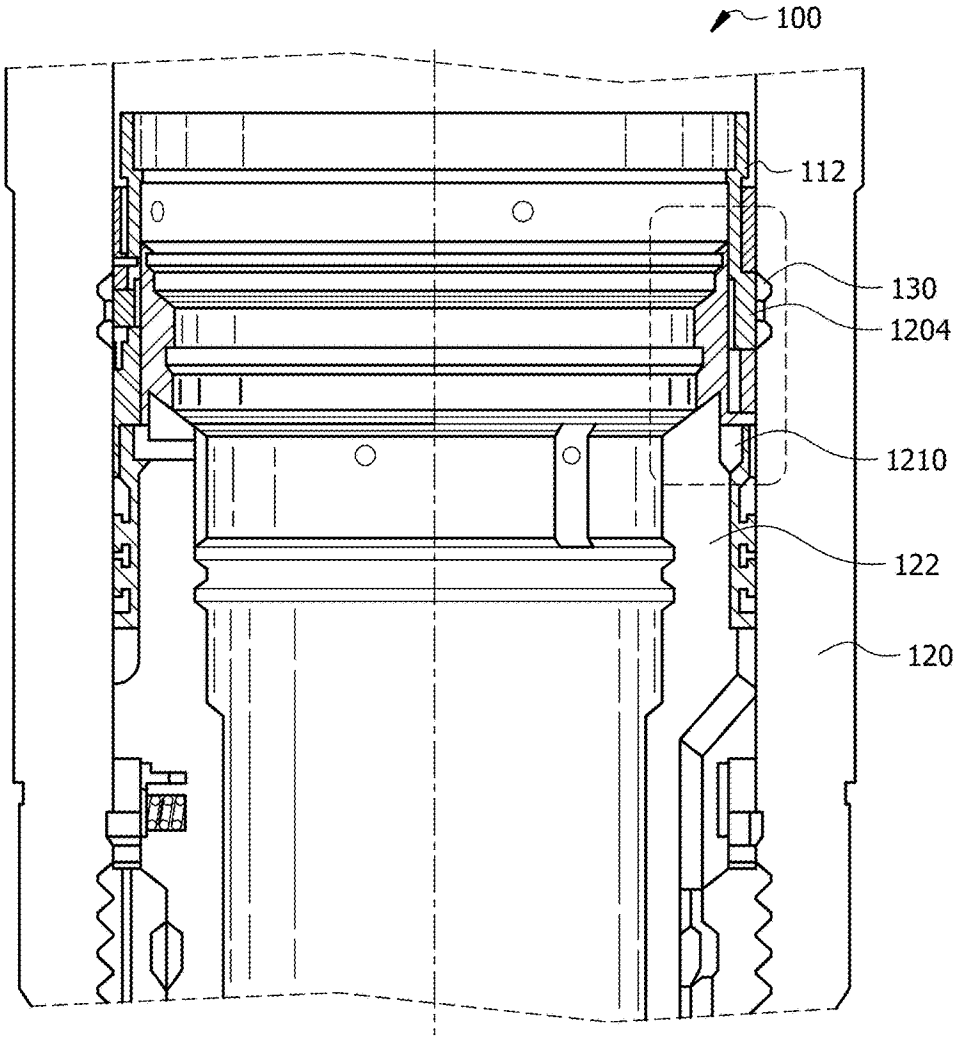

FIGS. 15A-15C illustrate perspective views of the seal assembly 100 with unlocked external lock ring 1204 and inner lock ring 1210, in accordance with an embodiment of the present disclosure. FIG. 15A shows a top view of the seal assembly 100 with a C-C section. FIG. 15B shows a cross section of the seal assembly 100 along the C-C section. In particular, lockdown sleeve 112 may not be actuated, and both external lock ring 1204 and inner lock ring 1210 are not locked. Thus, gap 130 exists between external lock ring 1204 and the upper edge of the complementary profile on the inner surface of wellhead housing 120. Seal assembly 100 does not have a rigidized seal between casing hanger 122 and wellhead housing 120. FIG. 15C shows a cutaway view of the seal assembly 100 around gap 130 of FIG. 15B. In an embodiment, gap 130 exists between external lock ring 1204 and the upper edge of the complementary profile on the inner surface of wellhead housing 120 when lockdown sleeve 112 is not actuated.

Figure 16A:
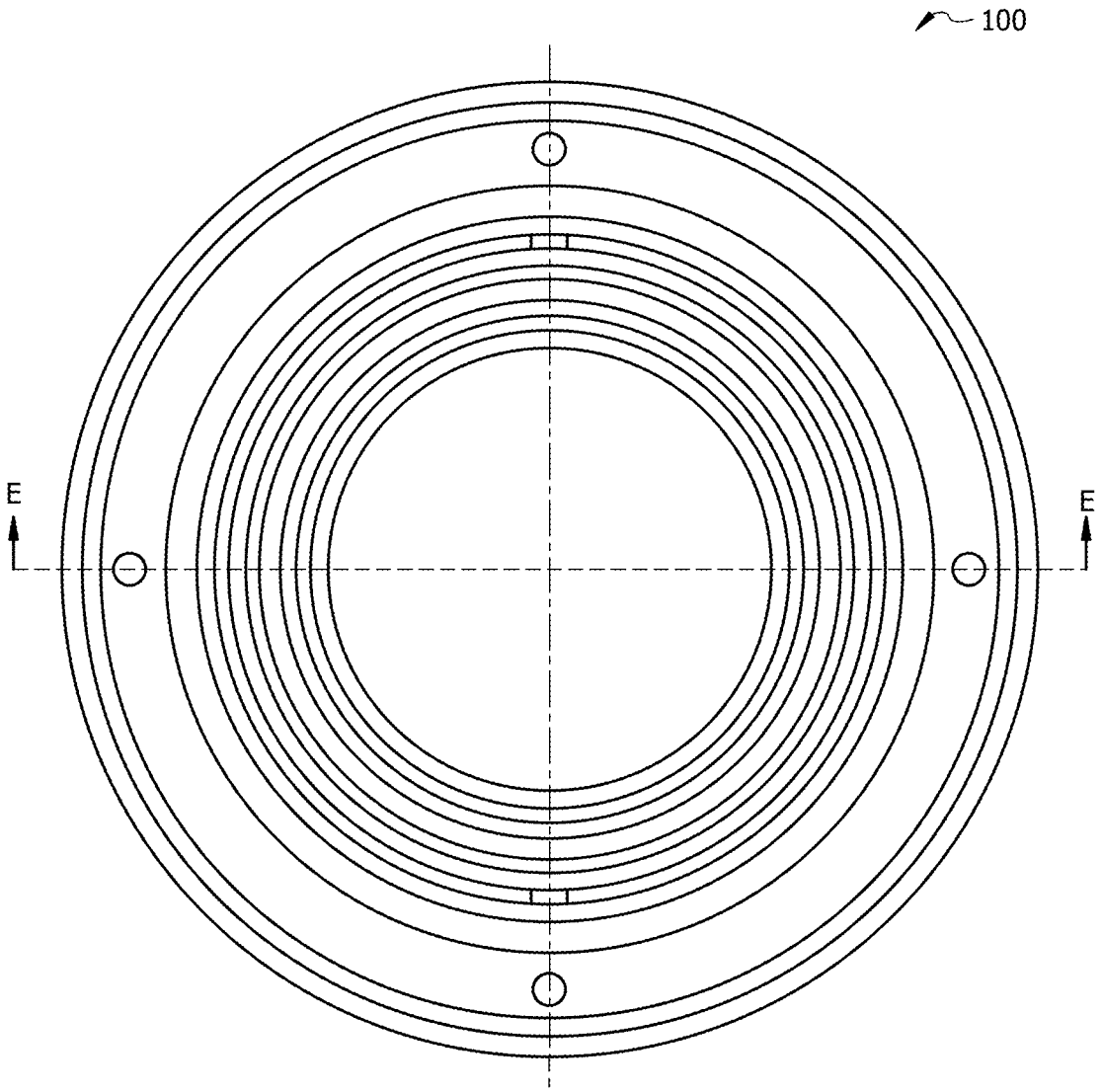
FIGS. 16A-16C illustrate perspective views of the seal assembly with a locked external lock ring and inner lock ring, in accordance with an embodiment of the present disclosure.
Figure 16C:
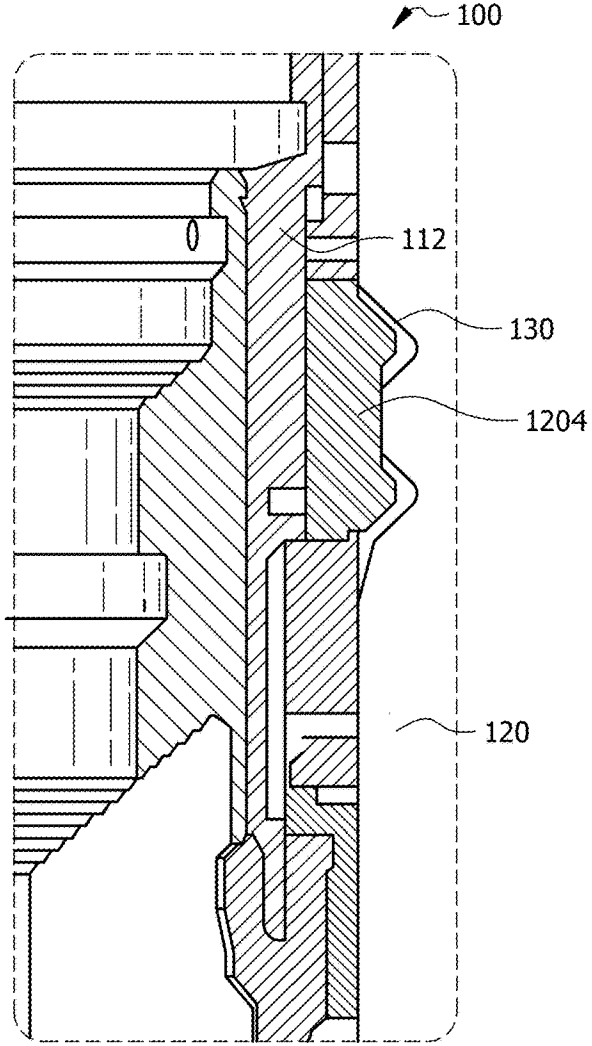
Figure 16B:
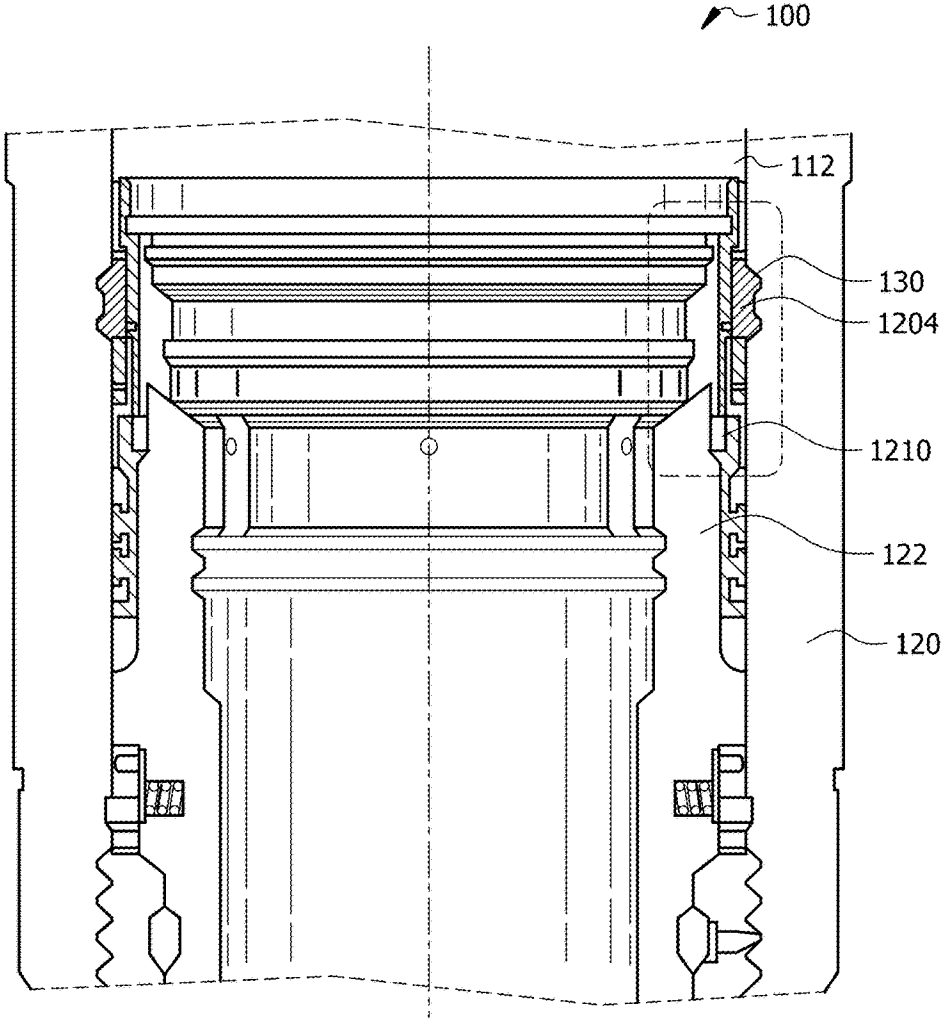

FIGS. 16A-16C illustrate perspective views of the seal assembly 100 with locked external lock ring 1204 and inner lock ring 1210, in accordance with an embodiment of the present disclosure. FIG. 16A shows a top view of the seal assembly 100. FIG. 16B shows a cross section of the seal assembly 100. In particular, lockdown sleeve 112 may be actuated, and both external lock ring 1204 and inner lock ring 1210 are locked. Thus, gap 130 reduces in size between external lock ring 1204 and the upper edge of the complementary profile on the inner surface of wellhead housing 120. Seal assembly 100 does not have a rigidized seal between casing hanger 122 and wellhead housing 120. FIG. 16C shows a cutaway view of the seal assembly 100 around gap 130 of FIG. 16B. In an embodiment, gap 130 reduces in size between external lock ring 1204 and the upper edge of the complementary profile on the inner surface of wellhead housing 120 when lockdown sleeve 112 is actuated.

Figure 17A:
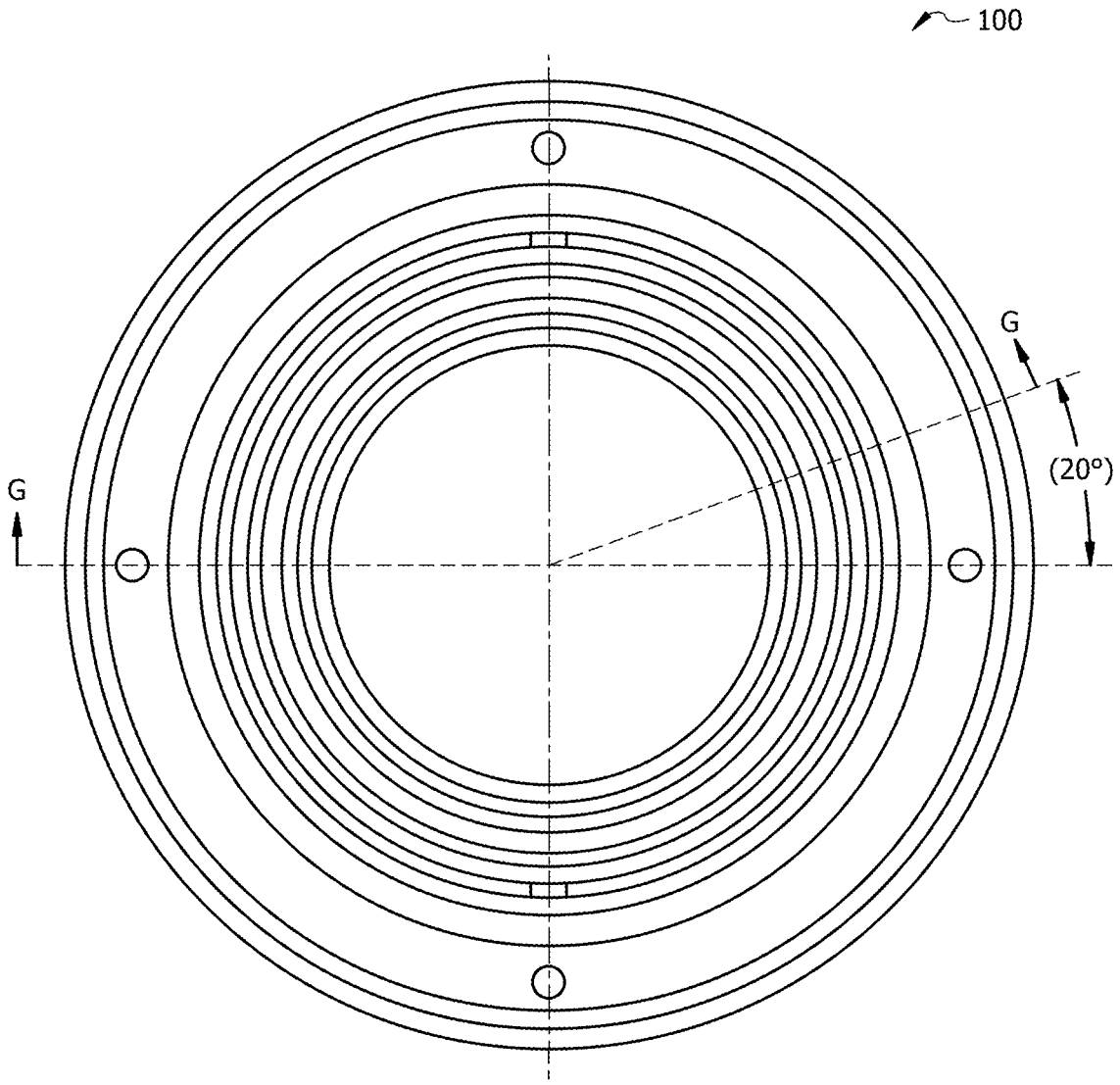
FIGS. 17A-17C illustrate perspective views of the seal assembly with a rigidized external lock ring, in accordance with an embodiment of the present disclosure.
Figure 17C:
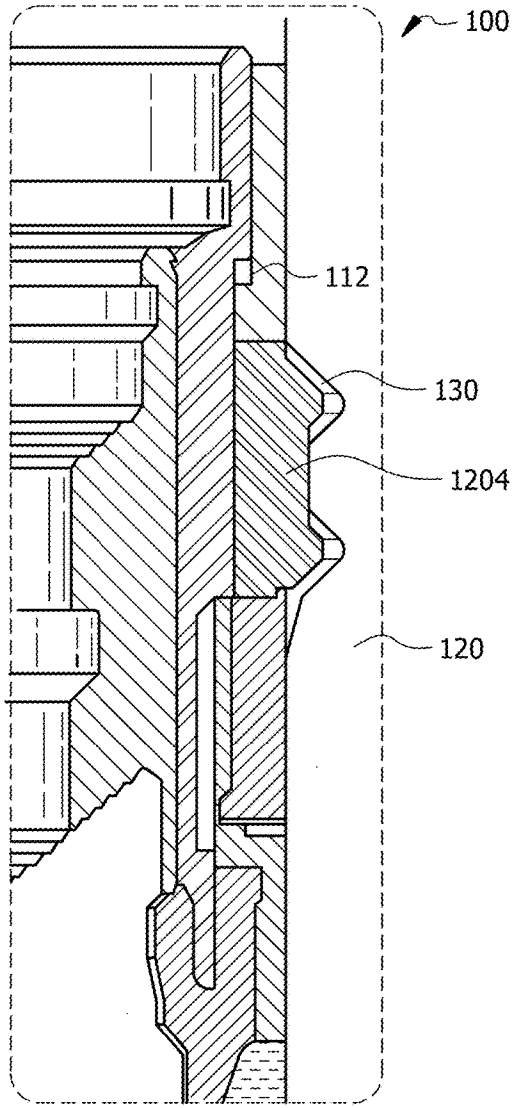
Figure 17B:
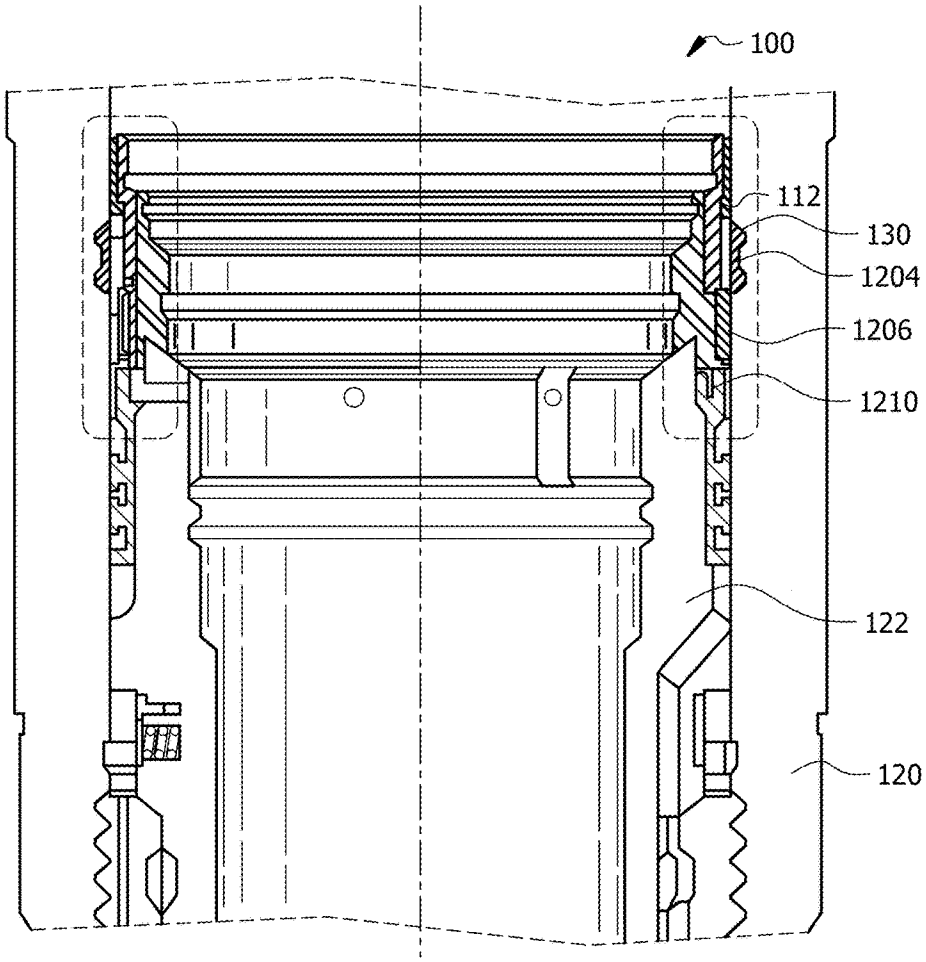

FIGS. 17A-17C illustrate perspective views of the seal assembly 100 with rigidized external lock ring 1204, in accordance with an embodiment of the present disclosure. FIG. 17A shows a top view of the seal assembly 100 with a G-G section. FIG. 17B shows a cross section of the seal assembly 100 along the G-G section. In particular, lockdown sleeve 112 and lock ring carrier 1206 are actuated and rotated, and both external lock ring 1204 and inner lock ring 1210 are locked. Thus, gap 130 reduces in size between external lock ring 1204 and the upper edge of the complementary profile on the inner surface of wellhead housing 120. Seal assembly 100 has a rigidized seal between casing hanger 122 and wellhead housing 120. FIG. 17C shows a cutaway view of the seal assembly 100 around gap 130 of FIG. 17B. In an embodiment, there may be no gap 130 between external lock ring 1204 and the upper edge of the complementary profile on the inner surface of wellhead housing 120 when lockdown sleeve 112 and lock ring carrier 1206 are actuated and rotated.

Although the present disclosure and its advantages have been described in detail, it should be understood that various changes, substitutions and alterations can be made herein without departing from the spirit and scope of the disclosure as defined by the following claims.

What is claimed is:

1. A system, comprising:
- a seal assembly configured to retain a casing hanger within a wellhead, the seal assembly comprising:
  - a main body comprising at least one tapered surface on an upper end thereof;
  - a lock ring coupled to the main body and configured to expand radially outward into a profile on an inner diameter of the wellhead;
  - at least one ramp coupled to a radially inner surface of a cam ring; and
  - the cam ring disposed above the main body and having at least one tapered surface on an end surface thereof, the at least one tapered surface of the cam ring interfacing with the at least one tapered surface of the main body such that rotation of the cam ring in a first direction with respect to the main body causes the lock ring to move axially upward.

2. The system of claim 1, wherein the seal assembly further comprises:
- a rotator ring having at least one ramp portion configured to interface with the at least one ramp upon lowering of the rotator ring with respect to the main body such that further lowering of the rotator ring causes the at least one ramp and the cam ring to rotate in the first direction.

3. The system of claim 2, wherein the seal assembly further comprises an actuator, wherein an interface between the actuator and the lock ring is capable of transferring an axial force from the actuator into outward radial expansion of the lock ring.

4. The system of claim 3, wherein the actuator is releasably coupled to the rotator ring.

5. The system of claim 4, wherein the seal assembly further comprises a pressure-actuated release mechanism coupling the actuator to the rotator ring.

6. The system of claim 5, wherein the pressure-actuated release mechanism comprises:
- a lever coupled to and extending from the rotator ring; and
- a groove formed in the actuator, wherein a distal end of the lever is disposed in the groove formed in the actuator.

7. The system of claim 1, wherein the main body is substantially cylindrical.

8. The system of claim 1, wherein the at least one tapered surface of the main body and the at least one tapered surface of the cam ring are angled approximately 0 to 90 degrees from horizontal.

9. The system of claim 1, wherein the seal assembly further comprises:
- a radially expandable spaceout indicator ring extending through a corresponding one or more slots in the cam ring, wherein the radially expandable spaceout indicator ring is configured to expand into a corresponding profile on the inner diameter of the wellhead to allow a lockdown sleeve of the seal assembly to travel its full stroke for rigidly locking the seal assembly in the wellhead.

10. The system of claim 1, wherein the seal assembly further comprises a seal coupled to the main body, wherein the seal is configured to seal an annulus between the casing hanger and the wellhead.

11. The system of claim 1, wherein the seal assembly further comprises a torque ring comprising:
- a ring body; and
- a first tab and a second tab operable to transfer a torque to the lock ring, wherein the first tab is longer than the second tab in length and extends through a split in the lock ring to interface with the threaded adjustment ring, and the second tab interfaces with a mating slot in the lock ring opposite from the split in the lockdown sleeve.

12. A method, comprising:
- positioning a seal assembly into a wellhead, the seal assembly comprising:
  - a main body having at least one tapered surface on an end thereof;
  - a lock ring coupled to the main body;
  - at least one ramp coupled to a radially inner surface of a cam ring; and
  - the cam ring coupled to the main body and having at least one tapered surface on an end surface thereof, the at least one tapered surface of the main body interfacing with the at least one tapered surface of the cam ring;
- actuating the lock ring of the seal assembly toward a profile on an inner diameter of the wellhead;
- during or after actuating the lock ring, adjusting an axial length of the seal assembly by rotating the cam ring in a first direction with respect to the main body, wherein a rotational movement of the cam ring causes the lock ring to move axially upward; and
- retaining a casing hanger in the wellhead via the seal assembly.

13. The method of claim 12, further comprising:
- lowering a rotator ring of the seal assembly with respect to the main body, the rotator ring having at least one ramp portion thereon;
- interfacing the at least one ramp portion of the rotator ring with the at least one ramp that is coupled to the cam ring; and
- lowering the rotator ring further with respect to the main body to cause the at least one ramp and the cam ring to rotate in the first direction with respect to the main body via interaction of the at least one ramp portion of the rotator ring with the at least one ramp.

14. The method of claim 13, further comprising actuating the lock ring via an actuator being lowered with respect to the main body, wherein the actuator is releasably coupled to the rotator ring.

15. The method of claim 14, further comprising releasing the rotator ring from the actuator upon further lowering the actuator with respect to the main body.

16. The method of claim 15, further comprising landing the actuator on a landing shoulder of the main body after releasing the rotator ring from the actuator.

17. The method of claim 15, wherein releasing the rotator ring from the actuator comprises:

forcing a lever coupled to the rotator ring to flex such that a distal end of the lever extending from the rotator ring moves out of a groove formed in the actuator.

18. The method of claim 12, further comprising:

expanding a radially expandable spaceout indicator ring into a corresponding profile on the inner diameter of the wellhead, the radially expandable spaceout indicator ring extending through a corresponding one or more slots in the cam ring to allow a lockdown sleeve of the seal assembly to travel its full stroke for rigidly locking the seal assembly in the wellhead.

19. The method of claim 12, further comprising:

sealing an annulus between the casing hanger and the wellhead via a seal coupled to the main body of the seal assembly; and deterring movement of the seal in an axial direction via a connection between the casing hanger, the seal assembly, and the wellhead.

20. The method of claim 12, wherein a gap is present between an uppermost edge of the lock ring and an uppermost edge of the profile of the wellhead when the lock ring is initially actuated, and wherein there is no gap between the uppermost edge of the lock ring and the uppermost edge of the profile of the wellhead after adjustment of the axial length of the seal assembly.

* * * * *